US007465226B2

(12) United States Patent
Ikeya et al.

(10) Patent No.: US 7,465,226 B2
(45) Date of Patent: Dec. 16, 2008

(54) MULTI-STATION GAME MACHINE

(75) Inventors: Tomonobu Ikeya, Tokyo (JP); Keiri Yoshioka, Tokyo (JP)

(73) Assignee: Konami Gaming Incorporated, Las Vegas, NV (US)

( * ) Notice: Subject to any disclaimer, the term of this patent is extended or adjusted under 35 U.S.C. 154(b) by 991 days.

(21) Appl. No.: 10/356,633

(22) Filed: Feb. 3, 2003

(65) Prior Publication Data

US 2003/0148804 A1 Aug. 7, 2003

(30) Foreign Application Priority Data

Feb. 1, 2002 (JP) ..... P2002-025699

(51) Int. Cl.
*A63F 9/24* (2006.01)

(52) U.S. Cl. ..... 463/16

(58) Field of Classification Search ..... 463/16–20, 463/22, 26; 273/142 R
See application file for complete search history.

(56) References Cited

U.S. PATENT DOCUMENTS 5,827,119 A * 10/1998 Bromley ..... 463/7
5,857,910 A * 1/1999 Watanabe et al. ..... 463/17
5,879,235 A * 3/1999 Kaneko et al. ..... 463/34
6,093,101 A * 7/2000 Mourad ..... 463/13
6,287,195 B1 * 9/2001 Sugimoto et al. ..... 463/20
6,302,791 B1 * 10/2001 Frohm et al. ..... 463/21
6,364,314 B1 * 4/2002 Canterbury ..... 273/274
6,413,162 B1 * 7/2002 Baerlocher et al. ..... 463/20
6,446,965 B1 * 9/2002 Boulton ..... 273/142 R
6,733,390 B2 * 5/2004 Walker et al. ..... 463/23
6,938,900 B2 * 9/2005 Snow ..... 273/292
2003/0064773 A1 * 4/2003 Baerlocher et al. ..... 463/16

FOREIGN PATENT DOCUMENTS

JP 06-238033 8/1994

OTHER PUBLICATIONS

Marshall Fey, Slot Machines, 1983, Nevada Publications, First Edition, p. 17.*

* cited by examiner

*Primary Examiner*—Corbett Coburn
*Assistant Examiner*—O. Deodhar
(74) *Attorney, Agent, or Firm*—Masuvalley & Partners

(57) ABSTRACT

A multi-station game machine, includes a plurality of reels, each reel having a plurality of symbols, and the reels spinning horizontally around a vertical axis. The reels are arranged coaxially in the vertical direction. Each of the reels has a circumferential length which enables at least two players to play a game on the game machine simultaneously.

4 Claims, 10 Drawing Sheets

SHARED PAYOUT LINE: ht14, ht15, ht16, ht17, ht18, ht19

MULTI-STATION GAME MACHINE

BACKGROUND OF THE INVENTION

The invention relates to a multi-station game machine which enables a plurality of players to play games together and in which symbols are moved horizontally.

A game machine 100 shown in FIG. 11 is a game machine in which one player plays a game. At the time of playing a game, a player initially inserts a plurality of tokens to be used for betting purpose, via a token insert slot 101.

The player presses any one of credit bet buttons 102*a*, 102*b*, and 102*c*, to thereby bet tokens on a desired one of payout lines p1, p2, p3, p4, and p5 along which symbols would constitute a certain winning combination.

Then, the player presses a start lever 103, to thereby start spinning symbol reels 111, 112, and 113, each having a predetermined number of symbols 121*e* . . . , 122*e* . . . , and 123*e* . . . drawn on peripheral faces thereof.

After having continued spinning for a while, the symbol reels 111, 112, and 113 are automatically, sequentially stopped.

If, after the reels are stopped, a winning combination is constituted by a symbol on the symbol reel 111, a symbol on the symbol reel 112, and a symbol on the symbol reel 113 that are aligned along a payout line on which the player bets tokens beforehand, a certain number of tokens assigned to the symbols are paid to the player via a token payout hole 104.

As mentioned above, the game machine 100 is a game machine on which a single player plays games, but fails to enable a plurality of players to play games simultaneously.

A predetermined number of symbols 121*e* . . . , 122*e* . . . , and 123*e* . . . are drawn on peripheral faces of the respective symbol reels 111, 112, and 113. As shown in FIG. 11, only three symbols appear on each of the symbol reels. Symbols other than these cannot be used for a combination game on the game machine 100 because they are concealed in the game machine 100. For this reason, the number of programmable payout lines are limited.

Accordingly, a person who is skilled in the art is expected to seek a manner of effectively utilize unused symbols and increase the number of payout lines.

In addition, when, during the course of a combination game, two of symbols that would constitute a certain big winning combination is already aligned with a payout line on which the player already bets tokens, sound effects are provided and lamps (not shown) are blinked in association with spinning of the final symbol reel. However, the effect of such presentation is languid and insufficient for inciting the gambling spirit and augmenting interest in games.

SUMMARY OF THE INVENTION

It is therefore an object of the present invention to provide a multi-station game machine which enables a plurality of players to enjoy playing games, effective utilization of symbols to be displayed, and augmentation of interest in games, and which is rich in terms of entertainment characteristic.

In order to achieve the above object, according to the present invention, there is provided a multi-station game machine comprising:

a plurality of reels, each reel having a plurality of symbols, and the reels spinning horizontally around a vertical axis, wherein the reels are arranged coaxially in the vertical direction; and wherein each of the reels has a circumferential length which enables at least two players to play a game on the game machine simultaneously.

In the above configuration, a plurality of players can enjoy playing games simultaneously.

According to the present invention, there is also provided a multi-station game machine, comprising;

a plurality of displays, each display displaying a symbol array, the symbol array having a plurality of symbols arranged in a first direction, and the symbols of each symbol array moving in the first direction, wherein the respective symbol arrays displayed on the respective displays are arranged in parallel each other; and wherein each display has a circumferential length which enables at least two players to play a game simultaneously.

In the above configuration, a plurality of players can enjoy playing games simultaneously.

Preferably, the multi-station game machine further comprises;

a plurality of speakers, each speaker being disposed around the reels; and a speaker controller, which controls emission of sound from the speakers and muting of the speakers.

In the above configuration, the speakers provided around a plurality of symbol reels emit sound or become muted, thereby enabling attractive presentation of games.

Preferably, the multi-station game machine further comprises:

a plurality of speakers, each speaker being disposed around the displays; and a speaker controller, which controls emission of sound from the speakers and muting of the speakers.

In the above configuration, speakers provided around a plurality of display sections emit sound or become muted, thereby enabling attractive presentation of games.

Preferably, the multi-station game machine, further comprises:

a plurality of lamps, each lamp being disposed around the reels; and a lamp controller, which controls illumination and extinction of the plurality of lamps.

In the above configuration, lamps disposed around the reels are illuminated and extinguished, thereby enabling attractive presentation of games.

Preferably, the multi-station game machine, further comprises:

a plurality of lamps, each lamp being disposed around the displays; and a lamp controller, which controls illumination and extinction of the plurality of lamps.

In the above configuration, the lamps disposed around symbol reels are illuminated and extinguished, thereby enabling attractive presentation of games.

Preferably, the multi-station game machine comprises a plurality of operating units, by which a plurality of players bet a game value on a payout line of the reels, and the payout line includes a shared payout line which is betted by the adjacent operating units.

Preferably, the multi-station game machine, further comprises a plurality of operating units, by which a plurality of players bet a game value on a payout line on the displays. The payout line includes a shared payout line which is betted by the adjacent operating units.

In the above configurations, the payout line include the shared payout line to be shared between and used by adjacent players. Hence, use of the shared payout line enables adjacent players to share the pleasure stemming from achievement of a win.

In order to avoid experiencing regret, which would otherwise be raised when a player does not bet any game values on a shared payout line, the player is motivated to bet game values on as many payout lines as possible, thereby fully enjoying a game.

Accordingly, there can be embodied a multi-station game machine which enables a large number of players to enjoy playing games together, effective utilization of symbols to be displayed, and augmentation of interest in a game.

Preferably, the plurality of symbols of the reels define a plurality of game areas on which the game is performed simultaneously.

The respective symbol arrays displayed on the respective displays define a plurality of game areas on which the game is performed simultaneously.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

An embodiment of a game machine according to the invention will be described hereinbelow by reference to the drawings.

Figure 1:
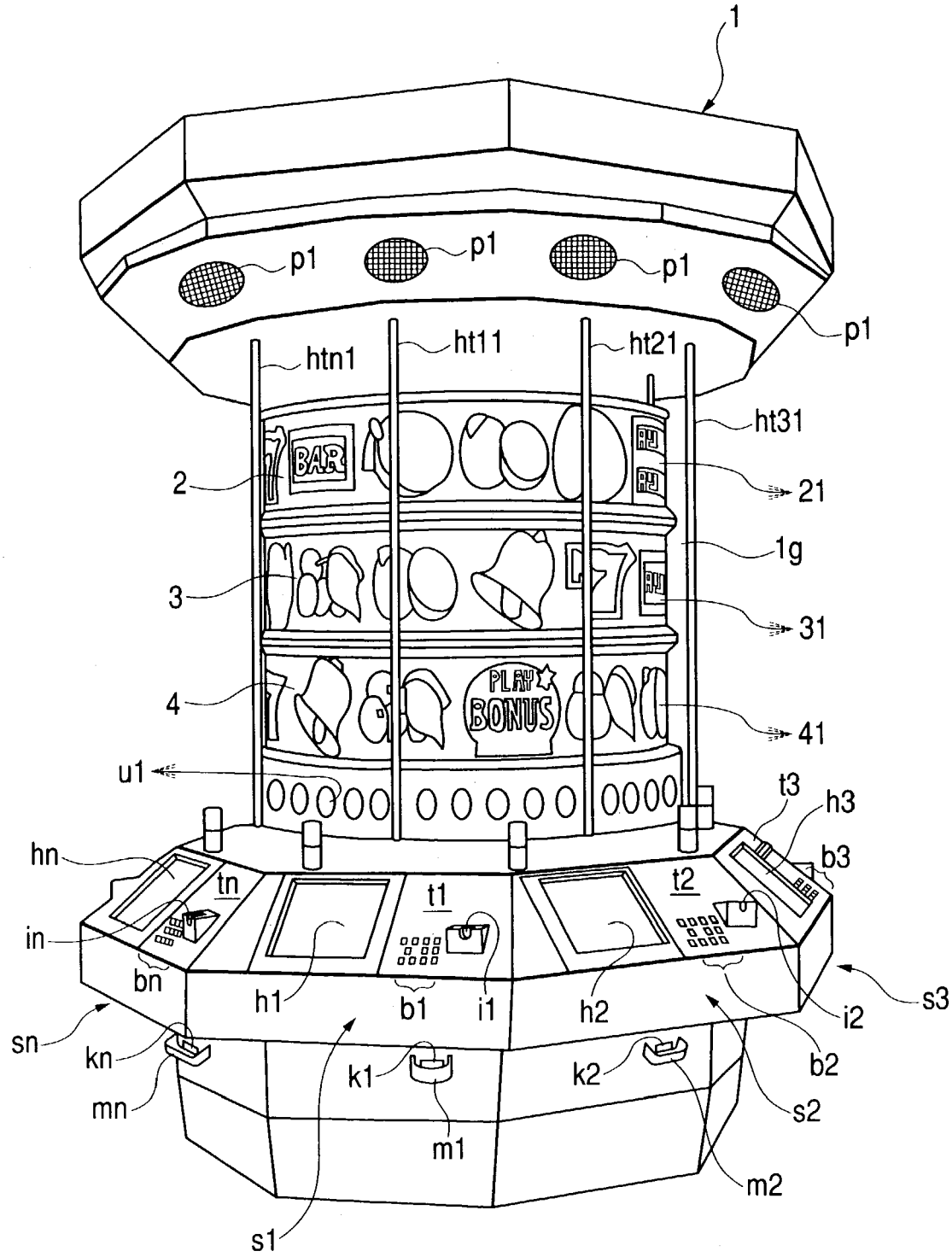
FIG. 1 is a perspective view showing a multi-station game machine according to an embodiment of the invention.
Figure 2:
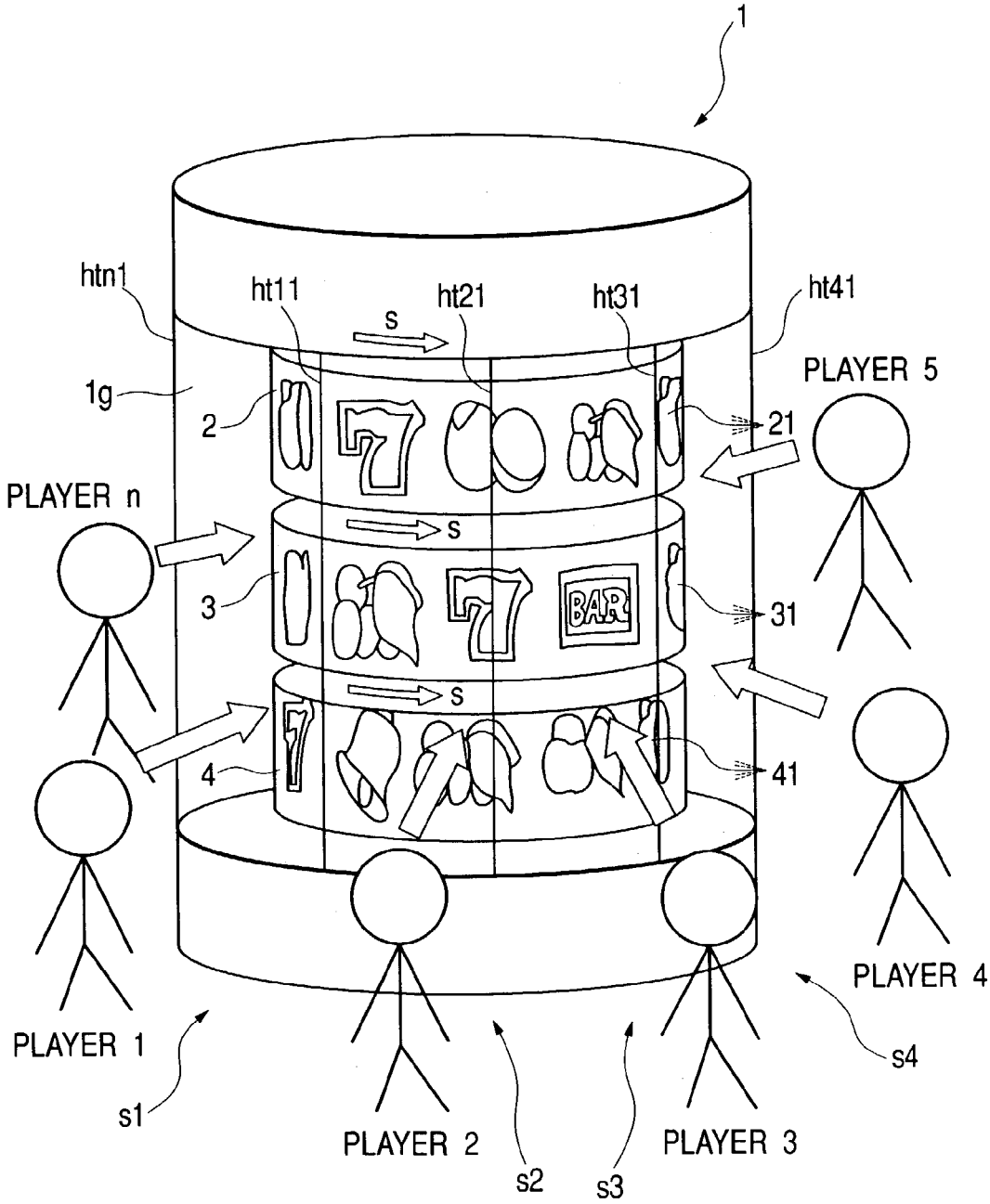
FIG. 2 is a conceptual perspective view showing a playing status of the multi-station game machine of the embodiment.

As shown in FIG. 1, and in FIG. 2, which is a conceptual rendering, a multi-station game machine 1 is a game machine on which a plurality of players enjoy playing combination games (first games), by using any of stations s1, s2, s3, s4, . . . sn.

At the time of a combination game, symbol reels 2, 3, and 4 spin horizontally (in the direction "s" of arrow shown in FIG. 2) around a vertical shaft in a concentric manner while displaying a plurality of symbols 21 . . . , a plurality of symbols 31 . . . , and a plurality of symbols 41 . . . on respective peripheral faces of the symbol reels. While the symbol reels 2, 3, and 4 are spinning, the players select desired payout lines from payout lines ht11, ht12, ht13 . . . (see FIG. 6, which will be described later) provided at the stations (any of s1, s2, . . . sn) occupied by the players, and bet previously-inserted game values, (e.g., tokens, coins, paper currency, or some form of credit indicator, such as a credit card) on the thus-selected payout lines.

After the players bet coins or tokens on the payout lines, the symbol reels 2, 3, and 4 are sequentially stopped. Symbols that would constitute a certain winning combination are aligned with the respective payout lines ht11, ht12, ht13 . . . . When the payout lines ht11, ht12, ht13, . . . along which the symbols are successfully aligned coincide with the payout lines on which the players bet coins or tokens, a predetermined number of coins or tokens assigned to the symbols that constitute a predetermined winning combination are paid to the players who are awarded wins.

As shown in FIG. 1, in the multi-station game machine 1, the symbol reel 2, on whose peripheral face symbols 21, 22, 23 . . . are displayed; the symbol reel 3, on whose peripheral face symbols 31, 32, 33, . . . are displayed; and the symbol reel 4, on whose peripheral face symbols 41, 42, 43, . . . are displayed are supported in a concentric manner so as to be rotatable around the vertical center. The multi-station game machine 1 is installed upright such that a protective glass 1*g* for protecting the outside of peripheral faces of the symbol reels 2, 3, and 4 assumes a cylindrical shape.

A predetermined number of speakers (game speakers) p1 for emitting sound effects for games are disposed in positions elevated from the symbol reels 2, 3, and 4. Further, a predetermined number of game lamps u1 . . . for emitting illumination effects for game are provided in positions lower than the symbol reels 2, 3, and 4 so as to surround an exterior circumferential wall face.

The outer peripheral section of the multi-station game machine 1 is divided into stations s1, s2, s4, s4 . . . sn, all having identical configurations, to be used by players at the time of playing games. Reference payout lines ht11, ht21, . . . htn1 (which will be described later), which are payout lines of one type, are arranged at positions on the protective glass 1*g* so as to correspond to the center positions of respective stations.

Here, the reference payout lines ht11, ht21, . . . htn1 are provided as colored translucent glass or plastic rods; e.g., yellow, blue, and green rods arranged on the protective glass 1*g*.

The reference payout lines ht11, ht21, . . . htn1 may be embodied by means of imparting a special refraction factor to the protective glass 1g such that translucent colors; e.g., yellow, blue, and green, may be isolated in the form of rods by means of illumination.

Operating tables t1, t2, t3, t4, . . . tn having control buttons b1, b2, b3, b4, . . . bn provided thereon are disposed, in a sloped manner, at positions on the respective stations s1, s2, s3, s4, . . . sn where the players can readily operate the buttons. Payout receivers m1, m2, m3, m4, . . . mn for storing coins or tokens ejected from hoppers (not shown) by way of payout holes k1, k2, k3, k4, . . . , tn are disposed at positions lower than the respective operating tables t1, t2, t3, t4, . . . so as to project forward from the wall face.

A symbol sheet on which the symbols 21, . . . are drawn and which is formed from polycarbonate or the like is affixed onto the peripheral face of the symbol reel 2; a symbol sheet on which the symbols 31, . . . are drawn and which is formed from polycarbonate or the like is affixed onto the peripheral face of the symbol reel 3; and a symbol sheet on which the symbols 41, . . . are drawn and which is formed from polycarbonate or the like is affixed onto the peripheral face of the symbol reel 4. Thus, the symbol reels 2, 3, and 4 display the symbols 21 . . . , the symbols 31 . . . , and the symbols 41 . . . to the players.

The symbols 21 . . . , the symbols 31 . . . , and the symbols 41 . . . are classified into symbols that would constitute a big winning combination; e.g., 7; symbols that would constitute a medium winning combination; symbols that would constitute a small winning combination; symbols that would constitute a bonus game; and remaining general symbols.

Outer shells of the respective symbol reels 2, 3, and 4 are formed from drums (not shown). With a view toward reducing the weight and inertia of the drums, lightweight material, such as an aluminum alloy or synthetic resin, is selected, thereby attempting weight reduction through, for example, a reduction in the thickness of constituent sections.

The spinning reels 2, 3, and 4 are rotated, by means of direct drive by stepping motors (not shown) which have good compatibility with a digital control system and rotate through only a preset angle. Position sensors (not shown) are adopted for stopping the spinning reels at predetermined positions, thereby effecting position control.

Position sensors that are employed are selected from optical sensors, such as photodiodes or phototransistors, or magnetic sensors utilizing electromagnetic induction, as required.

Needless to say, a transmission mechanism which employs transmission belts and gear mechanisms, as required, may be adopted for effecting rotation of the respective symbol reels 2, 3, and 4.

In order to enable players to easily view the symbols 21 . . . , the symbols 31 . . . , and the symbols 41 . . . , internal lamps (not shown) are provided within the respective symbol reels 2, 3, and 4 for illuminating symbols on the peripheral faces of the spinning reels from the inside thereof.

Incidentally, the symbols 21 . . . , the symbols 31 . . . , and the symbols 41 . . . are also illuminated from the outside of the spinning reels by external lamps (not shown).

In the embodiment, the symbol reels 2, 3, and 4 are constituted of mechanical reels having true-to-life characteristics, thereby displaying the symbols 21 . . . , the symbols 31 . . . , and the symbols 41 . . . . Here, the symbol reels may be constituted of symbol display devices for displaying the symbols of the plurality of symbol reels by images, such as an LCD (liquid-crystal display), a CRT (cathode-ray tube), or a DLP (digital light processing) projector using an image display device DMD (digital micro-mirror device).

Specifically, there may also be employed a symbol display system in which display sections (corresponding to the peripheral faces of the symbol reels 2, 3, and 4) are vertically stacked side by side into a plurality of layers, each section sequentially displaying images of a plurality of symbols in a circulatory manner by horizontally moving in the form of a row of predetermined sequence.

In the multi-station game machine 1 having the symbol display system for displaying images of the symbols, the outer circumferential face of the game machine 1 may assume an arbitrary shape other than the shape of a cylindrical face, such as an elliptic cylindrical shape.

Since the operating table t1 of the station s1 is identical in construction with the operating tables t2, . . . tn of the other stations s2, s3, s4, . . . sn, an explanation is given of only the operating table t1.

The operating table t1 is constituted of an operation display panel (individual display section) h1; a control button section b1 consisting of a plurality of types of control buttons; and a coin insert slot i1 into which coins or tokens are inserted.

The operation display panel h1 is constructed from a CRT display or an LCD and is used for displaying a bet time, an indication to be used when the player bets coins or tokens on the payout lines ht1, . . . during a period of bet time, the end of a bet time, and the symbols 21, 31, 41, . . . of the symbol reels 2, 3, 4 which are to spin after the bet time; and is used by the player for ascertaining the history of game results and the number of remaining coins or tokens.

Control buttons of the control button section 1*b* includes a line selection button to be used for selecting payout lines from the payout lines ht1 . . . and making the selected payout line valid; a bet button to be used for betting a coin or token one by one on the payout lines ht1 . . . that are selected and made valid; a maximum bet button to be used for betting a maximum number of coins or tokens on the payout lines ht1 . . . that are selected and made valid; a remaining credit check button; a credit payoff button; an employee call button, and other buttons as required. Predetermined processing is performed by a player pressing any of the buttons.

So long as a touch panel method is employed for the operation display panel h1, the panel may play the role of press buttons.

Figure 3:
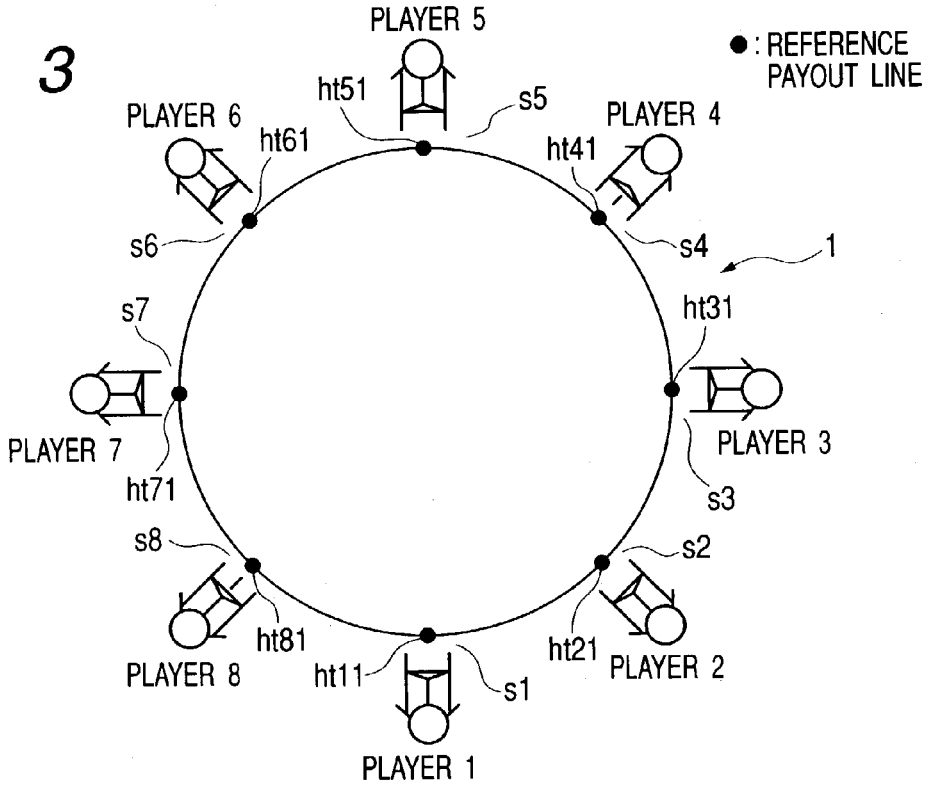
FIG. 3 is a conceptual plan view showing the layout of players when the multi-station game machine of the embodiment has eight stations.

As shown in FIG. 3, when the multi-station game machine 1 of the foregoing configuration has eight stations s1, s2, . . . S8 to be used by respective players, eight players can simultaneously enjoy playing a combination game.

Figure 4:
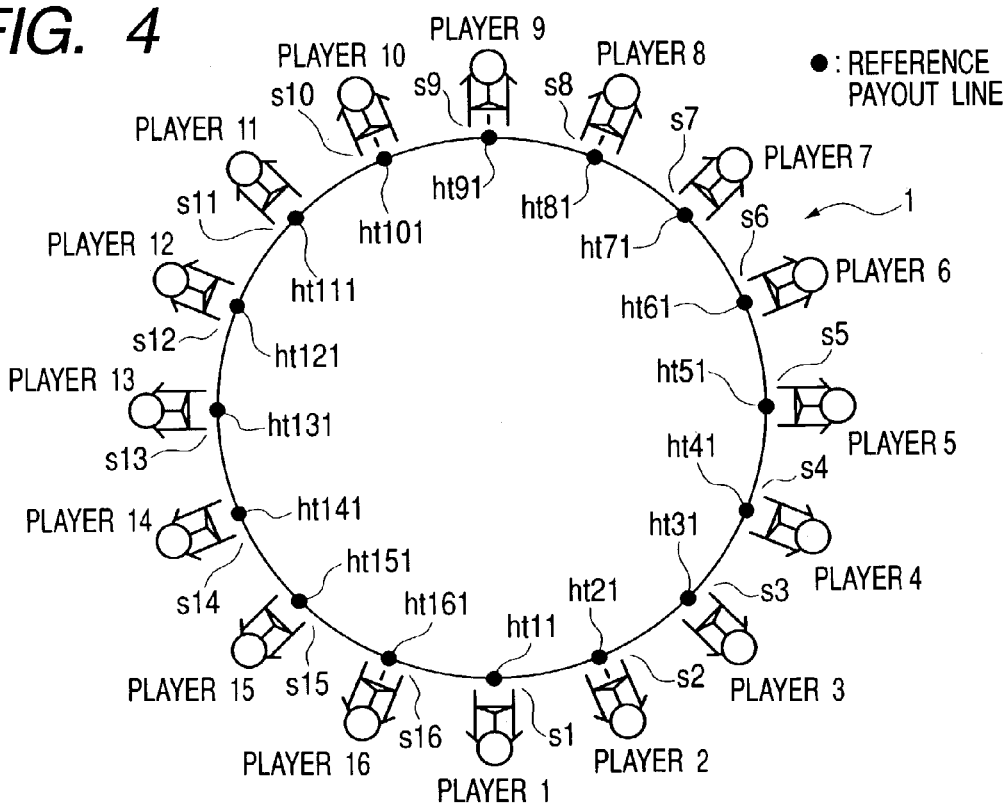
FIG. 4 is a conceptual plan view showing the layout of players when the multi-station game machine of the embodiment has 16 stations.

As shown in FIG. 4, when the multi-station game machine 1 has 16 stations, s1, . . . S16, 16 players can simultaneously enjoy playing a combination game. The number of stations can be selected as, for example, 10, 12, 14, . . . , as required. Players equal in number to the stations can simultaneously enjoy playing a combination game.

Figure 5A:
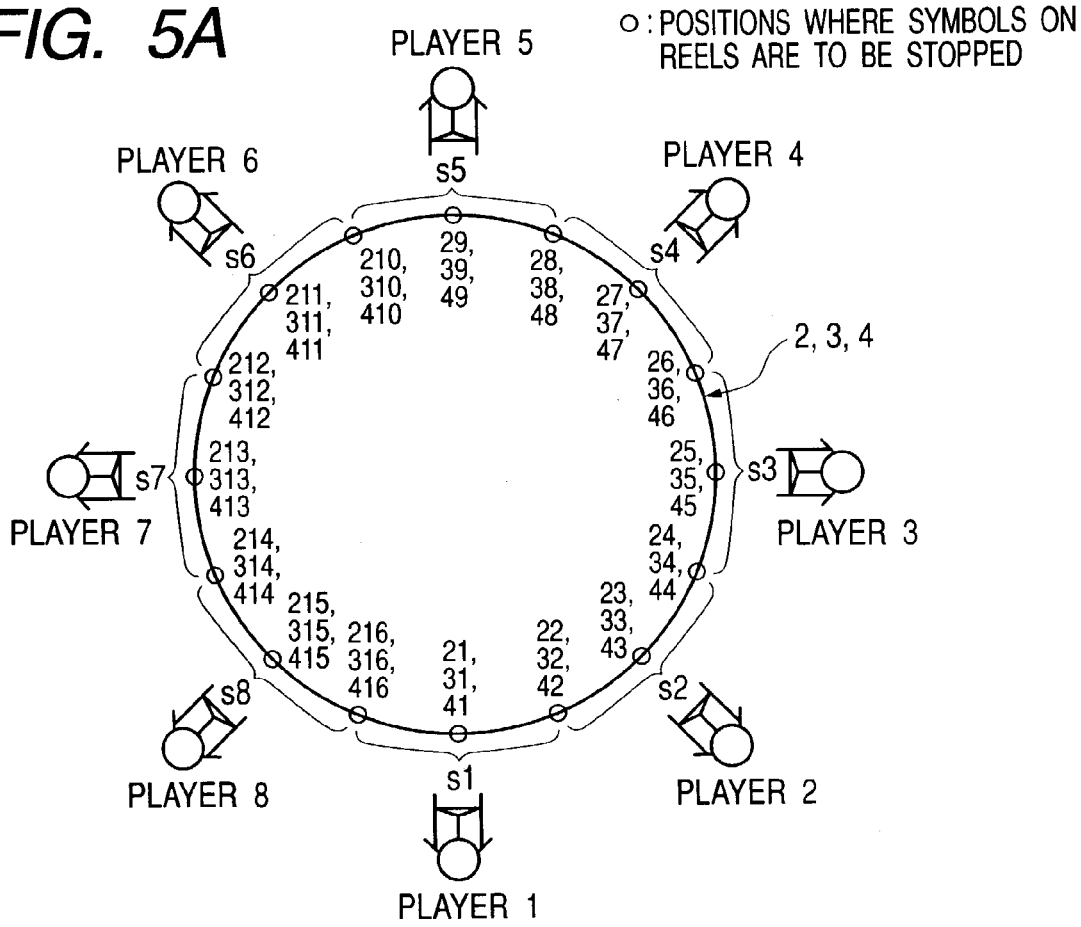
FIG. 5A is a conceptual plan view and FIG. 5B is a conceptual perspective view, both showing an example relative positional relationship between stations and positions where symbols on symbol reels are to be stopped when the multi-station game machine of the embodiment has eight stations and 16 symbols are provided on a peripheral face of each of the symbol reels.

For instance, the multi-station game machine 1 is designed to have eight stations s1 through s8 such that the symbol reel 2 has 16 symbols 21, 22, . . . 216 provided on a peripheral face thereof; such that the symbol reel 3 has 16 symbols 31, 32, . . . 316; and such that the symbol reel 4 has 16 symbols 41, 42, . . . 416. In such a case, the relative positional relationship between the stations and the stop positions of the symbols on the respective symbol reels 2, 3, and 4 can be set to that shown in FIG. 5A.

The symbols numbered 21, 22, . . . 216; the symbols numbered 31, 32, . . . 316; and the symbols numbered 41, 42, . . . 416 are assigned numbers for convenience of explanation; in practice, specific numbers are not designated.

Figure 5B:
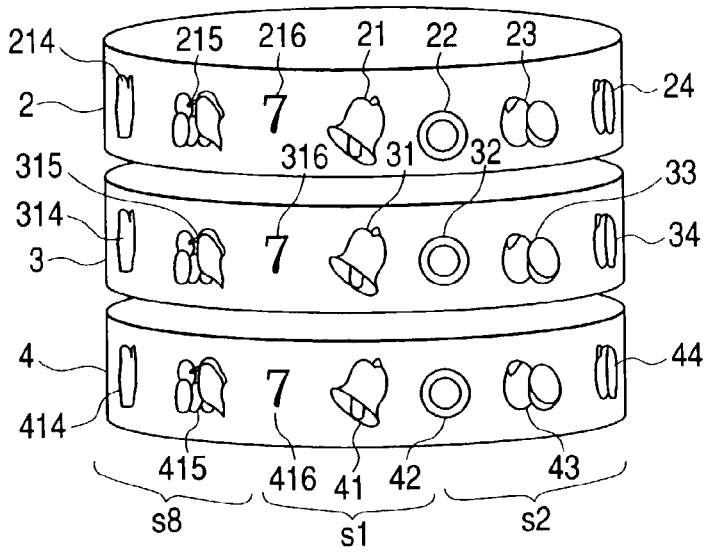

As can be seen from FIG. 5, the multi-station game machine 1 is arranged such that three of the 16 symbols 21, . . . 216 on the symbol reel 2, three of the 16 symbols 31, . . . 316 on the symbol reel 3, and three of the symbols 41, . . . , 416 on the symbol reel 4 are assigned to the respective stations s1, s2, . . . , s n when the spinning symbol reels 2, 3, and 4 are stopped.

More specifically, the symbols 216, 21, and 22 on the symbol reel 2, the symbols 316, 31, and 32 on the symbol reel 3, and the symbols 416, 41, and 42 on the symbol reel 4 are stopped at the station s1; the symbols 22, 23, and 24 on the symbol reel 2, the symbols 32, 33, and 34 on the symbol reel 3, and the symbols 42, 43, and 44 on the symbol reel 4 are stopped at the station s2; . . . , the symbols 214, 215, and 216 on the symbol reel 2, the symbols 314, 315, and 316 on the symbol reel 3, and the symbols 414, 415, and 416 on the symbol reel 4 are stopped at the station s8.

FIG. 6 shows an example of the multi-station game machine 1 in which payout lines ht11, ht12, and ht13 are available for the player of the station s1 with regard to the symbols on the stationary symbol reels 2, 3, and 4.

The station s8 is disposed on the left side of the station s1, and the station s2 is disposed on the right side of the station s1.

Figure 6A:
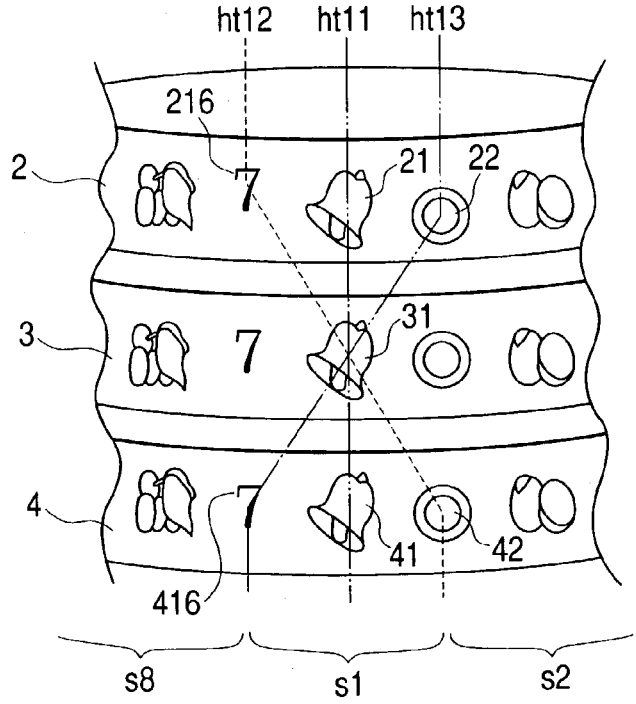
FIGS. 6A and 6B are perspective views of the multi-station game machine shown in FIG. 5, wherein 6A shows payout lines to be used for solely a station s1 and 6B shows shared payout lines to be shared between and used by the station s1 and adjacent stations.

FIG. 6A shows the payout lines ht11, ht12, and ht13 to be used solely for the station s1.

The payout line ht11 is a vertical straight payout line provided at the center of the station s1. In the case of symbols illustrated in FIG. 6A, the payout line ht11 is formed by combination of the symbol 21 on the symbol reel 2, the symbol 31 on the symbol reel 3, and the symbol 41 on the symbol reel 4.

The payout line ht12 is sloped downward from left to right on a display area of the station s1. In the case of the symbols illustrated in FIG. 6A, the payout line ht12 is constituted by combination of the symbol 216 on the symbol reel 2, the symbol 31 on the symbol reel 3, and the symbol 42 on the symbol reel 4.

The payout line ht13 is sloped downward from right to left on the display area of the station s1. In the case of the symbols illustrated in FIG. 6A, the payout line ht13 is constituted by combination of the symbol 22 on the symbol reel 2, the symbol 31 on the symbol reel 3, and the symbol 416 on the symbol reel 4.

Figure 6B:
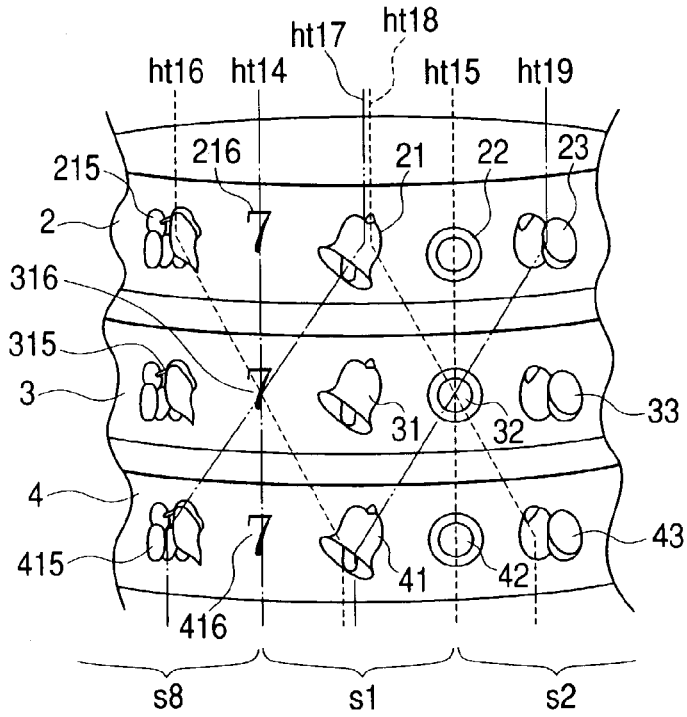

FIG. 6B shows payout lines ht14, ht16, and ht17 to be shared between the stations s1 and s8, and payout lines ht15, ht18, and ht19 to be shared between the stations s1 and s2.

The payout line ht14 is a straight, vertical payout line provided on the left side of the display area of the station s1 and is also used for the station s8. In the case of the symbols illustrated in FIG. 6B, the payout line ht14 is formed by combination of the symbol 216 on the symbol reel 2, the symbol 316 on the symbol reel 3, and the symbol 416 on the symbol reel 4.

The payout line ht16 is a sloped payout line provided on the display area of the station s1 and is also used for the station s8. In the case of the symbols illustrated in FIG. 6B, the payout line ht16 is formed by combination of the symbol 215 on the symbol reel 2, the symbol 316 on the symbol reel 3, and the symbol 41 on the symbol reel 4.

The payout line ht17 is a sloped payout line provided on the display area of the station s1 and is also used for the station s8. In the case of the symbols illustrated in FIG. 6B, the payout line ht16 is formed by combination of the symbol 21 on the symbol reel 2, the symbol 316 on the symbol reel 3, and the symbol 415 on the symbol reel 4.

The payout line ht15 is a straight, vertical payout line provided on the right side of the display area of the station s1 and is also used for the station s2. In the case of the symbols illustrated in FIG. 6B, the payout line ht15 is formed by combination of the symbol 22 on the symbol reel 2, the symbol 32 on the symbol reel 3, and the symbol 42 on the symbol reel 4.

The payout line ht18 is a sloped payout line provided on the display area of the station s1 and is also used for the station s2. In the case of the symbols illustrated in FIG. 6B, the payout line ht18 is formed by combination of the symbol 21 on the symbol reel 2, the symbol 32 on the symbol reel 3, and the symbol 43 on the symbol reel 4.

The payout line ht19 is a sloped payout line provided on the display area of the station s1 and is also used for the station s2. In the case of the symbols-illustrated in FIG. 6B, the payout line ht19 is formed by combination of the symbol 23 on the symbol reel 2, the symbol 32 on the symbol reel 3, and the symbol 41 on the symbol reel 4.

As mentioned previously, the payout lines ht14, ht16, ht17 shared between the station s1 and the adjacent station s8 and the payout lines ht15, ht18, ht19 shared between the station s1 and the adjacent station s2 are particularly designated as shared payout lines.

More specifically, among payout lines, those shared between two adjacent stations are called shared payout lines.

For station s1, the payout lines ht11 through ht19, including the shared payout lines, are provided. However, other payout lines, including other shared payout lines, can also be provided.

Payout lines including shared payout lines analogous to those employed in the station s1 are used even in stations s2, s3, s4, s5, s6, s7, and s8.

The reference payout lines ht11, ht21, ht31, . . . htn1 provided for the respective stations s1, s2, . . . sn are embodied by adoption of center vertical payout lines in the respective stations from among the previously-described payout lines as reference payout lines.

The reference payout lines ht11, ht21, ht31, . . . htn1 are not necessarily embodied by the center vertical payout lines of the respective stations. However, adoption of the center vertical payout lines is more preferable, for explicitly representing the respective stations s1, s2, . . . sn.

In the embodiment, the payout lines ht12, ht13, . . . other than the reference payout lines ht11, ht21, ht31, . . . htn1, which are to be offered to respective players, are drawn on the protective glass 1g.

A celebratory payout and a shared bonus payout are set as payouts to be provided when a win is achieved at any of the shared payout lines ht14, ht16, ht17, ht15, ht18, and ht19 by a winning combination.

In the case of the related game machine, when a winning is achieved as a result of symbols on the symbol reels that would constitute a winning combination which are aligned with a payout line on which the player does not bet coins or tokens, nothing is paid to the player.

In contrast, in the multi-station game machine 1, even when a player does not bet any coins or tokens on a shared payout line in advance before start of a game, if another player playing at an adjacent station bets coins or tokens on that shared payout line before initiation of the game, and if a win is achieved on the shared payout line as a result of start of the game, coins or tokens are paid to the player who bets coins or tokens as a reward for achievement of a win. In addition, coins or tokens are also paid to the player who does not bet coins or tokens, as a celebratory payout.

For example, as shown in FIG. 5, a player 1 who is playing games at the station s1 is assumed not to bet any coins or tokens on the shared payout line ht15 between the stations s1 and s2, which is shown in FIG. 6B, in advance before start of a game.

Provided that a player 2 playing at the station s2 bets coins or tokens on the shared payout line ht15 in advance before start of a game, if symbols that constitute a winning combination are aligned along the shared payout line ht15 as a result of the spinning symbol reels 2, 3, 4 that are stopped after start of a game, to thereby achieve a win, coins or tokens corresponding to a reward for achievement of a win along the shared payout line ht15 are paid to the player 2. Further, coins or tokens are also paid to the player 1 who does not bet any coins or tokens on the shared payout line ht15, as a celebratory payout associated with achievement of a win along the shared payout line ht15.

As in the case of the shared payout line ht15, a celebratory payout is also provided even on other shared payout lines.

Next will be described the shared bonus payout. In this example situation, a player bets coins or tokens on a shared payout line in advance before start of a game, and another player playing at an adjacent station also bets coins or tokens on that shared payout line in advance before start of a game. If both player bet coins or tokens on the same shared payout line and if a win is achieved along the shared payout line on which the players bet coins or tokens, after start of a game, coins or tokens corresponding to a reward for achievement of a win on the shared payout line are paid to both players. In addition, a bonus payout is also paid to both players as a shared bonus payout.

For example, as shown in FIG. 5, the player 1 playing at the station s1 is assumed to bet coins or tokens on the payout line ht16, which is shared between the stations s1 and s8 and is shown in FIG. 6B, in advance before start of a game. The player 8 playing at the station s8 is also assumed to bet coins or tokens on the shared payout line ht16 in advance before start of a game.

If the game is started and a win is achieved as a result of symbols that constitute a winning combination that are aligned along the shared payout line ht16 after the spinning symbol reels 2, 3, and 4 are stopped, a payout corresponding to a reward for achievement of a win is paid to the players 1 and 8. In addition, a bonus payout is paid to the players 1 and 8 as a shared bonus payout.

Even on the remaining shared payout lines, a shared bonus payout is paid as in the case of the shared payout line ht16.

As mentioned above, the celebratory payout and the shared bonus payout to be paid to the player 1 are described as examples of payouts to be paid when a winning combination are established along a shared payout line. Needless to say, under similar conditions, the celebratory payout and the bonus payout are paid to the other players 3, 4, . . . 8 in the same manner.

Figure 7:
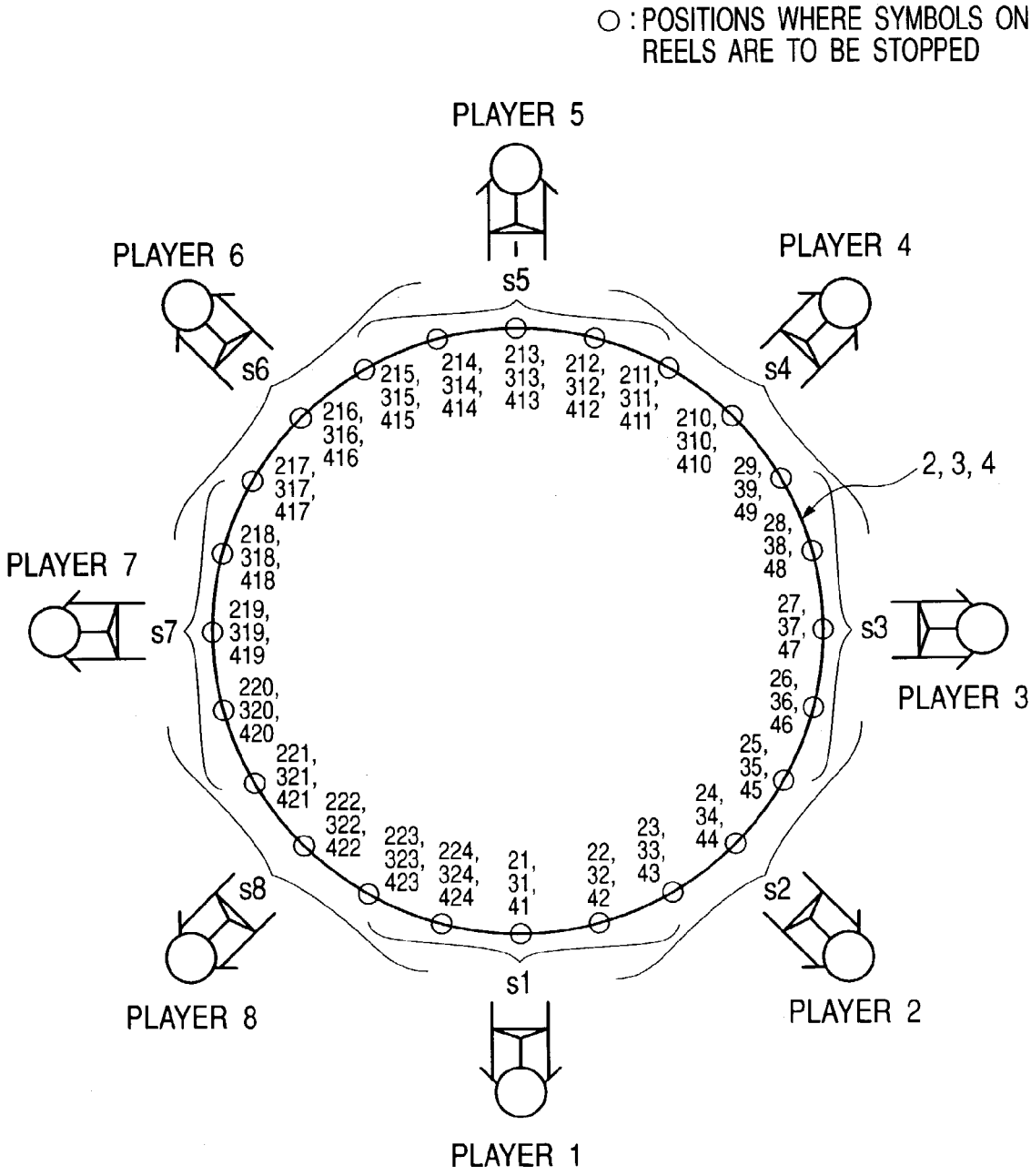
FIG. 7 is a conceptual plan view of the multi-station game machine of the embodiment, showing an example of a relative positional relationship between stations and positions where symbols on symbol reels are to be stopped when eight stations are provided and 24 symbols are provided on the peripheral face of each of the symbol reels.

A multi-station game machine 1 shown in FIG. 7 is an example of game machine having stations s1, s2, . . . s8 which enable eight players to simultaneously enjoy playing a combination game. In this example, symbols 21, 22, . . . 224 are provided on the peripheral face of the symbol reel 2; symbols 31, 32, . . . 324 are provided on the peripheral face of the symbol reel 3; and symbols 41, 42, . . . 424 are provided on the peripheral face of the symbol reel 4.

As can be seen from FIG. 7, symbols 223, 224, 21, 22, 23 on the symbol reel 2, symbols 323, 324, 31, 32, 33 on the symbol reel 3, and symbols 423, 424, 41, 42, 43 on the symbol reel 4 are stopped on the station s1 of the multi-station game machine 1; symbols 22, 23, 24, 25, 26 on the symbol reel 2, symbols 32, 33, 34, 35, 36 on the symbol reel 3, and symbols 42, 43, 44, 45, 46 on the symbol reel 4 are stopped displayed on the station s2 of the multi-station game machine 2; . . . , similarly, symbols 220, 221, 222, 223, 224 on the symbol reel 2, symbols 320, 321, 322, 323, 324 on the symbol reel 3, and symbols 420, 421, 422, 423, 424 on the symbol reel 4 are stopped on the station s8 of the multi-station game machine 1.

More specifically, the game machine is set such that five symbols of the symbols 21 . . . on the symbol reel 2, five symbols of the symbols 31 . . . on the symbol reel 3, and five symbols of the symbols 41 . . . on the symbol reel 4 are assigned to respective stations s1, s2, . . . s8 when the spinning symbol reels 2, 3, 4 are stopped.

Even in the multi-station game machine of the embodiment, payout lines including shared payout lines are produced. In addition to a basic payout to be paid for establishment of a winning combination, the celebratory payout and the shared bonus payout are paid for the shared payout lines.

Figure 8:
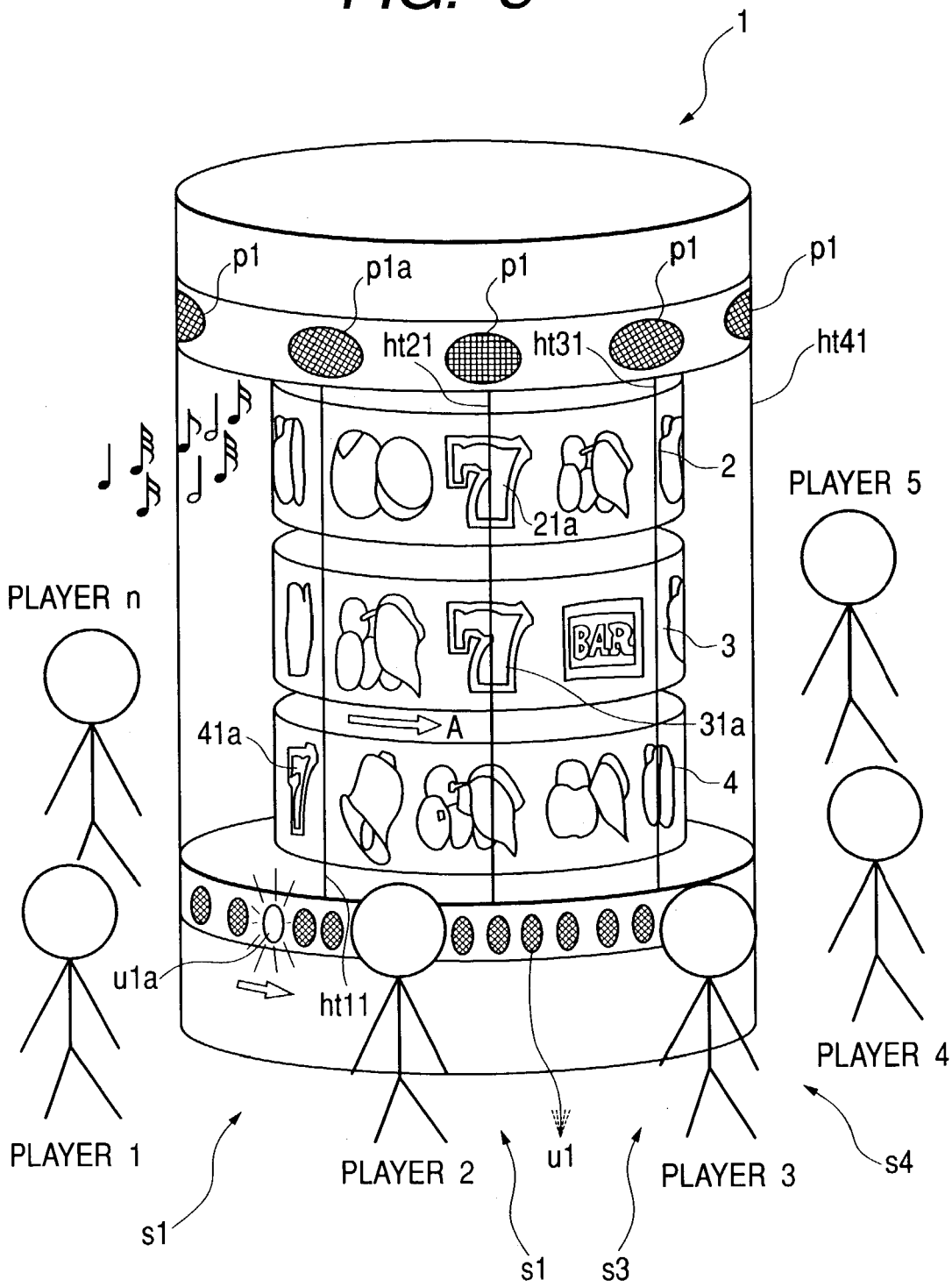
FIG. 8 is a conceptual perspective view showing that predetermined symbols that would constitute a winning combination are already aligned with a payout line while a symbol which would constitute a winning combination along with the predetermined symbols remains, and that a symbol reel having a final symbol which is not determined is spinning.

As shown in FIGS. 1 and 8, in the multi-station game machine 1, a plurality of speakers p1 and a plurality of game lamps 1 are provided around the symbol reels 2, 3, and 4. In association with rotations of the symbols 21 . . . on the symbol reel 2, the symbols 31 . . . on the symbol reel 3, and the symbols 41 . . . on the symbol reel 4 performed during games, game sound effects are emitted from the speakers p1; sound images are caused to go around the game machine; optical game effects are emitted from the game lamps u1; and illuminated light or blinking light is caused to go around the game machine, to thereby enable presentation of a game which provides audiovisual stimulation.

An explanation is now given of revolving of sound images and revolving of illumination light or blinking light. When a winning combination is established by symbols determined by internal random selection or a result of combination of symbols, game sound effects are emitted from the speakers p1, sound images are caused to go around the game machine, optical game effects are emitted from the game lamps u1, and illumination light or blinking light is caused to go around the game machine, as an advance notice of establishment of a winning combination, along with rotation of symbols on the peripheral face of any one of the symbol reels 2, 3, 4 which are currently spinning and are to be stopped next.

As establishment of a winning combination which involves emission of the game sound effects and optical game effects, establishment of a big winning combination, establishment of a medium winning combination, establishment of a small winning combination, and establishment of a bonus game is selected, as required, and the thus-selected winning combination is applied.

As establishment of a winning combination other than those set forth, there is selected and applied, as required, establishment of a winning combination involving a payout of predetermined number of bills or predetermined amount of money; e.g., a payout of 50 bills or more, a payout of 100 bills or more, a payout of 1000 bills or more, a payout of 100 dollars or more, or a payout of 1000 dollars or more, or a payout of an arbitrary number of bills or an arbitrary amount of money.

Here, a case where establishment of a big winning combination (involving the maximum payout) is determined by means of internal random selection is now illustrated. As shown in FIG. 8, which is a conceptual rendering of players in the course of playing a game, game sound effects are emitted from the speaker p1 located close to a symbol 21*a* (a symbol involving a maximum payout) on the symbol reel 2 of the spinning symbol reels 2, 3, 4, in a situation where the symbol reel 2 is to be stopped first and the symbol 21*a* would constitute a big winning combination (hereinafter simply called a "big win symbol 21*a*"), and sound images are caused to go around the game machine. Moreover, optical game effects are emitted from the game lamp u1 located close to the big win symbol 21*a*, and illumination light or blinking light goes around the game machine.

After the symbol reel 2 is stopped, game sound effects are emitted from the speaker p1 located close to a symbol 31*a* (a symbol involving a maximum payout) on the symbol reel 3 of the spinning symbol reels 2, 3, 4, in a situation where the symbol reel 3 is to be stopped second and the symbol 31*a* would constitute a big winning combination (hereinafter simply called a "big win symbol 31*a*"), and sound images are caused to go around the game machine. Moreover, optical game effects are emitted from the game lamp u1 located close to the big win symbol 31*a*, and illumination light or blinking light goes around the game machine.

After the symbol reel 3 is stopped, game sound effects are emitted from a speaker p1 a located close to a symbol 41*a* (a symbol involving a maximum payout) on the symbol reel 4 of the spinning symbol reels 2, 3, 4, in a situation where the symbol reel 4 is to be finally stopped and the symbol 41*a* would constitute a big winning combination (hereinafter simply called a "big win symbol 41*a*"), and sound images are caused to go around the game machine. Moreover, optical game effects are emitted from a game lamp u1*a* located close to the big win symbol 41*a*, and illumination light or blinking light goes around the game machine.

There may also be adopted, as required, a presentation of changing the sound of or increasing the volume of the game sound effects emitted from the speaker p1*a* located close to the big win symbol 41*a* on the symbol reel 4 to be stopped finally in relation with those emitted for the symbol reels 2, 3. Thus the game sound effects with reference to the symbol reel 4 is stopped finally are different from the game sound effects emitted for the symbol reel 4 from those emitted for the symbol reels 2, 3.

Similarly, there may also be adopted, as required, a presentation of changing the hue of or increasing the saturation or brightness of the optical game effects emitted from the game lamp u1*a* located close to the big win symbol 41*a* on the symbol reel 4 to be stopped finally in relation with those emitted for the symbol reels 2, 3. Thus the optical game effects with reference to the symbol reel 4 are different from the optical game effects emitted for the symbol reel 4 from those emitted for the symbol reels 2, 3.

A presentation other than those set forth may also be employed. As shown in FIG. 8, for example, establishment of a big winning combination is assumed to be established by the internal random selection. The big win symbol 21*a* on the symbol reel 2 are aligned with and stopped at the reference payout line ht21 of the station s2. Subsequently, the big win symbol 31*a* on the symbol reel 3 are aligned with and stopped at the reference payout line ht31 of the station s3. Finally, the symbol reel 4 is spinning in the direction of arrow A. In such a situation, sound effects for establishment of a big winning combination are emitted from the speaker p1*a* located close to the big win symbol 41*a* in association with rotation of the big win symbol 41*a* on the symbol reel 41. In addition, attractive optical effects for establishment of a big winning combination are emitted from the game lamp u1*a* located close to the big win symbol 41*a*, thereby enabling presentation for causing sound images and illumination light or blinking light to go around the game machine.

In this way, when the two big win symbols 21*a*, 31*a* are already aligned with the payout line ht21 and the symbol reel 4 is not stopped for display and is still spinning, sound images for establishment of a big winning combination and optical effects or blinking light for establishment of a big winning combination are caused to go around the game machine in association with the spinning action of the big win symbol 41*a* on the symbol reel 4. Thus, the interest of the player who is expected to benefit from a big winning combination is enhanced more and more.

In the example, when establishment of a big winning combination is determined by the internal random selection, sound effects for establishment of a big winning combination are emitted from the speaker p1*a* located close to the big win symbol 41*a* in association with spinning action of the big win symbol 41*a* on the symbol reel 4. Attractive optical effects for establishment of a big winning combination are emitted from the game lamp u1*a* located close to the big win symbol 41*a* in association with spinning action of the big win symbol 41*a* on the symbol reel 4. Needless to say, the foregoing configuration can also be applied to establishment of a winning combination other than a big winning combination; e.g., establishment of a medium winning combination, establishment of a small winning combination, establishment of a bonus game (i.e., a second game), or establishment of a winning combination involving a payout higher than a predetermined payout.

In relation to presentation of the game sound effects and optical game effects, effects to be emitted may be limited to only game sound effects or only optical game effects. Alternatively, both the game sound effects and the optical game effects may be emitted in conjunction with each other.

Figure 9:
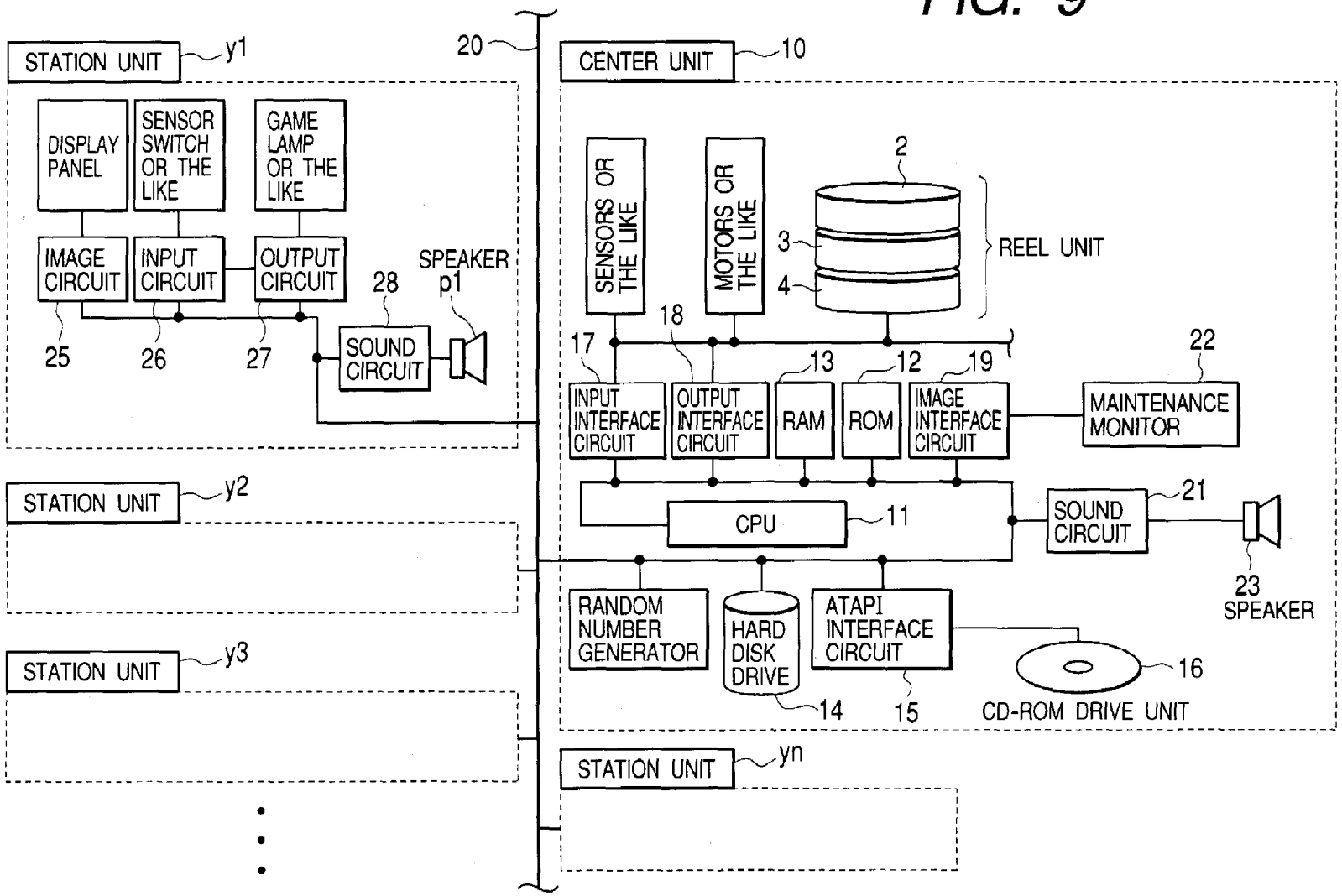
FIG. 9 is a block diagram showing a control configuration of a multi-station game machine according to the embodiment of the invention.

Control configuration of the multi-station game machine 1 will now be described by reference to FIG. 9.

Control of the multi-station game machine 1 is configured such that a center unit 10 controlling the overall game machine in accordance with a stored control program is connected with station units y1, y2, . . . , yn which are disposed so as to correspond to the respective stations s1, s2, s3, s4, . . . sn and control sections of the respective stations s1, s2, s3, s4, . . . sn, the control sections exchanging control signals with the center unit 10, transmitting output data, and receiving input data, by way of a system bus 20 of 16-bit or 32-bit width.

The station units y1, y2, . . . , yn are of identical configuration.

The center unit 10 is configured by means of connecting together, by way of the system bus 20, a CPU (central processing unit) (also called a game speaker controller and a game lamp controller) 11 which serves as a central processing unit; ROM (read-only memory) 12, which is non-volatile memory; RAM (random-access memory) 13, which is volatile memory; a hard disk drive 14 having a large storage capacity; a CD-ROM drive 16 connected to the center unit 10 by way of an ATAPI (advanced technology attachment packet interface) interface circuit 15; and interface circuits 17, 18, 19, 21.

The ROM 12 has control data or a table to be used for controlling rotation and stoppage of the symbol reels 2, 3, and 4 through use of a timer (not shown).

The table stored in the ROM 12 includes, e.g., a table for controlling stoppage of symbol reels; a table having combinations of symbols that would constitute winning combinations (hereinafter simply called a "win achievement symbol combination table"); a speaker position table; and a game lamp position table.

In the stop control table to be used for controlling stoppage of the symbol reels, symbols on the symbol reels 2, 3, 4 and their arrangements are recorded in an associated manner. When a relative positional relationship between a symbol on the symbol reel 2, a corresponding symbol on the symbol reel 3, and another corresponding symbol on the symbol reel 4 are determined, relative positional relationships between other symbols are determined automatically.

For instance, when 16 symbols are provided on each of the symbol reels 2, 3, and 4, symbol codes 1 through 16 are appended to respective symbols on the symbol reels 2, 3, and 4. A relative positional relationship between other symbols is recognized by reference to the symbols on the symbol code 1, thereby controlling stoppage of the symbol reels 2, 3, and 4.

Here, establishment of a winning combination by means of the symbols on the symbol reels 2, 3, and 4 that are stopped is determined by use of random numbers generated at predetermined probabilities by means of a random number generator consisting of a hardware counter. The random number generator may be constituted by use of software.

Stored in the win achievement symbol combination table are data pertaining to symbols which are to be aligned along the payout lines ht1 . . . and determine establishment of a bonus game. Moreover, stored in the table are data pertaining to the number of coins or tokens to be supplied to a player in accordance with establishment of various winning combinations.

The speaker position table is a table on which are recorded positions of the speakers 1*p* of the multi-station game machine 1.

The game lamp position table is a table on which are recorded positions of the game lamps u1 of the multi-station game machine 1.

A control program to be used for controlling the overall multi-station game machine 1 is recorded on the ROM 12. The control program is used for driving stepping motors and controlling stop positions of the respective stepping motors, the motors being used for spinning the symbol reels 2, 3, and 4; controlling hoppers to be used for paying out coins or tokens; performing processing for betting coins or tokens on any of the payout lines ht1 . . . ; ascertaining the number of remaining coins or tokens; ascertaining game results; operation control for blinking the game lamps u1 . . . ; and control for outputting sound to the speakers p1 . . . .

Here, the control program is manufactured by use of C language. However, the program may be produced by use of assembler language.

A work area to be used for executing the control program is generated in the RAM 13, or variable data are temporarily stored in the RAM 13.

More specifically, stored in the RAM 13 are data pertaining to the number of coins or tokens inserted into and paid out of the respective stations s1, s2, s3, s4, . . . , and a total number of coins or tokens inserted into and paid out from the respective stations.

By means of executing the program stored in the ROM 12, the CPU 11 controls the respective stepping motors to be used for spinning the symbol reels 2, 3, 4 and the overall multi-station game machine 1, such as various processing operations corresponding to input operations of players.

Stored in the hard disk drive 14 are data pertaining to results of games played at the respective stations and a history of game results.

The CD-ROM drive 16 is used for loading CD-ROMs having image data or the like recorded thereon into display panels of the respective stations s1, s2, s3, s4, . . . sn, or for loading CD-ROMs having a control program of updated version stored therein at the time of installation of the control program of updated version.

An input interface circuit 17 functions as an input interface for inputs from position sensors or the like for sensing positions of the symbol reels 2, 3, 4, and an output interface circuit 18 functions as an output interface for outputs, such as control signals, from the CPU 11 to the stepping motors of the respective symbol reels 2, 3, 4.

A maintenance monitor 22 is a monitor to be used by a game machine manager for performing maintenance on the multi-station game machine 1. A display section of the maintenance monitor 22 is constituted of a CRT or an LCD.

An image interface circuit 19 functions as an output interface for outputting an image signal from the CPU 11. The image interface circuit 19 outputs the image signal input from the CPU 11 to the maintenance monitor 22 by means of expansion and digital-to-analog conversion of the image data.

An audio interface circuit 21 is an output interface for outputting an audio signal output from the CPU 11 to a speaker 23 as an audio signal by means of decoding the audio signal.

As mentioned above, the station units y1, y2, . . . yn are of identical configuration, and hence an explanation is now given of only the station unit yl.

The station unit y1 plays the role of an output interface for outputting an image signal output from the CPU 11 to the display panel h1 which displays progress in a game and a player's operation.

An image circuit 25 outputs the image signal transmitted from the CPU 11 to the display panel h1 as image information by means of expansion and digital-to-analog conversion of the image signal.

An input circuit 26 provided in the station unit y1 is an input interface for inputting, into the CPU 11, a signal output from a sensor, such as a coin sensor (not shown) for sensing coins or tokens inserted by way of a coin insert slot i1, or a signal output from a switch, such as a button switch to be turned on when a button of a control button section b1 is pressed.

An output circuit (game lamp controller) 27 disposed in the station unit y1 is an output interface for outputting the signal delivered from the CPU 1 to the game lamps u1 . . . , which lamps emit optical game effects, or to a hopper or the like which pays out coins or tokens, and is constituted of an amplifying circuit or the like.

A sound circuit (game speaker controller) 28 disposed at the station unit y1 is an output interface for outputting an audio signal, which is delivered from the CPU 11 to the speaker p1, to the speaker p1 as an audio signal through decoding.

Next will be described control processing of the multi-station game machine 1 in each of game modes (see FIGS. 1, 2, 8, and 9).

Here, control processing of the multi-station game machine 1 is performed by means of execution of the control program recorded on the ROM 12.

Game modes of the multi-station game machine 1 are generally divided into a game when power is turned on, a normal game, and a bonus game.

When power of the multi-station game machine 1 is turned on, systems disposed in the center unit, such as the ROM 12, the RAM 13, and the hard disk drive 14, are inspected.

Next, the control program loads image data from the CD-ROM loaded in the CD-ROM drive 16 and transmits the image data to the respective image circuits 25 of the station units y1, y2, y3, y4, . . . by way of the system bus 20.

The respective image circuits 25 of the station units y1, y2, y3, y4, which are received image data output image information to the respective display panels h1 . . . , whereby a game image appears on each of the display panels h1 . . . .

When a normal game is started, a control program is executed, whereupon a symbol reel drive signal is transmitted to the stepping motors from the CPU 11 to the output circuit 18, to thereby start spinning of the symbol reels 2, 3, and 4.

Information about positions of the symbols on the spinning symbol reels 2, 3, and 4 is transmitted to the respective image circuits 25 of the station units y1, y2, y3, y4, . . . , and the image circuits 25 output image information to the respective display panels h1 . . . .

The display panels h1 . . . into which the image information is input display the symbols 21 . . . on the spinning symbol reel 2, the symbols 31 . . . on the spinning symbol reel 3, and the symbols 41 . . . on the spinning symbol reel 4.

Concurrently, bet time information is transmitted to the respective image circuits 25 of the stations units y1, y2, y3, y4, . . . from the CPU 11. A bet time information screen appears on the respective display panels h1, . . . of the stations s1, s2, s3, s4, . . . sn, thereby informing respective players of a bet time.

On the bet time information screen, each of the players bets a desired number of coins or tokens inserted for each of the desired payout lines ht11, . . . .

More specifically, each of the players selects desired payout lines from the payout lines ht11 . . . appearing on the bet time information screen by means of pressing a line selection button of the control button section b1. The player presses a bet button or maximum bet button of the control button section b1, to thereby display a desired number of coins or tokens from among the coins or tokens inserted on the bet time information screen and then bets the desired number of coins or tokens.

A line selection input signal output from a button switch of a line selection button and a number-of-bets set input signal output from a bet button or a button switch for the maximum bet button are transmitted to the CPU 11 as bet setting input signals by way of the input circuit 26.

Upon receiving the bet setting input signals for the respective stations s1, s2, s3, s4, . . . sn, the CPU 11 records the signals as bet information in the RAM 13 or the hard disk drive 14 for respective stations s1, s2, s3, s4, . . . sn.

Needless to say, the maximum number of coins or tokens to be bet, which is set by the maximum bet button, can be arbitrarily set; for example, to 10, 12, . . . .

When a predetermined period of bet time counted by the timer is ended, the CPU 11 transmits bet time end information to the display panels h1 . . . of the respective stations s1, s2, s3, s4, . . . sn, and the information appears on the display panels h1 . . . , whereupon the bet time information screen is terminated.

As a result, only the symbols 21 . . . on the spinning symbol reel 2, the symbols 31 . . . on the spinning symbol reel 3, and the symbols 41 . . . on the spinning symbol reel 4 appear on the display panels h1 . . . .

Concurrently, the following control operation is performed, as required. Namely, the CPU 11 sequentially transmits an audio signal to the speakers p1 . . . by way of an sound circuit 28. In accordance with spinning actions of the symbols 21 . . . on the symbol reel 2, the symbols 31 . . . on the symbol reel 3, and the symbols 41 . . . on the symbol reel 4, game sound effects are emitted from the speakers p1, and sound images are caused to go around the game machine.

After a predetermined period of time counted by the timer since the end of the bet time, spinning actions of the symbol reels 2, 3, and 4 are sequentially stopped by use of the timer.

Here, when establishment of a winning combination is determined by symbols, or as a result of combination of symbols through internal random selection, the symbols which are to constitute a winning combination and their positions on the symbol reels 2, 3, and 4 are grasped by use of the win achievement symbol combination table, the stop control table, and the position sensors. Then, there is performed, as required, a presentation of emitting game sound effects from the speaker p1 located close to the symbols which are to constitute a winning combination on the symbol reels 2, 3, 4, thereby causing sound images to go around the game machine, emitting optical game effects from the game lamp u1 located close to the symbols which are to constitute a winning combination, and causing illumination light or blinking light to go around the game machine.

For example, when establishment of a winning combination is determined by symbols, or as a result of combination of symbols through internal random selection, game sound effects are emitted from the speaker p1 located close to the symbols which are to constitute a winning combination and provided on any of the symbol reels 2, 3, 4, the reels being currently spinning and to stop; sound images are caused to go around the game machine; optical game effects are emitted from the game lamp u1 located close to the symbols that are to constitute a winning combination; and illumination light or blinking light is caused to go around the game machine.

Alternatively, when establishment of a big winning combination is determined by symbols, or as a result of combination of symbols through internal random selection, the following presentation is performed: namely, game sound effects for establishment of a big winning combination are emitted from the speaker p1*a* located close to the big win symbol 41*a* on the symbol reel 4, the reel still spinning after the symbol reels 2 and 3 are stopped; sound images are caused to go around the game machine; optical game effects for establishment of a big winning combination are emitted from the game lamp u1*a* located close to the big win symbol; and illumination light or blinking light is caused to go around the game machine.

As shown in FIG. 8, establishment of a big winning combination is assumed to be determined by symbols or as a result of combination of symbols through internal random selection. The big win symbol 21*a* on the symbol reel 2 is assumed to be stopped and aligned with the reference payout line ht21 of the station s1. Subsequently, the big win symbol 31*a* on the symbol reel 3 is assumed to be stopped and aligned with the reference payout line ht21. The symbol reel 4 which are not stopped and whose symbol to be stopped is not yet determined is assumed to still be spinning in the direction of arrow A. Under these circumstances, the CPU 11 recognizes that the big win symbol 21*a* on the symbol reel 2 and the big win symbol 31*a* of the symbol reel 3 are stopped and aligned with the reference payout line ht21, through use of the stop control table stored in the ROM 12.

Subsequently, the CPU 11 grasps the spinning position of the big win symbol 41*a* of the symbol reel 4 by use of the position sensor for the symbol reel 4 and the stop control table stored in the ROM 12.

The CPU 11 determines the speaker 1*a* and the game lamp u1*a* located most close to the spinning position of the big win symbol 41*a*, by use of the speaker position table and the game lamp position table.

The CPU 11 transmits a game sound effect signal to the speaker p1*a* by way of the sound circuit 28 of the station (i.e., any one of the stations s1, s2, s3, s4, . . . sn) where the speaker p1*a* is located.

Similarly, the CPU 11 transmits an optical game effect signal to the speaker u1*a* by way of the output circuit 27 of the station (i.e., any one of the stations s1, s2, s3, s4, . . . sn) where the game lamp u1*a* is located.

In this way, when establishment of a big winning combination is determined, game sound effects for establishment of a big winning combination are emitted from the speaker p1*a* located close to the big win symbol 41*a* on the symbol reel 4, the reel still spinning. Simultaneously, attractive optical game effects for establishment of a big winning combination are emitted from the game lamp u1 a located close to the big win symbol 41*a*. In association with movement of the big win symbol 41*a* of the symbol reel 4 which is not stopped and whose symbol to be stopped is not determined, sound effects for establishment of a big winning combination and optical effects for establishment of a big winning combination are emitted.

Concurrently, information about the symbols on the stationary symbol reels 2, 3, and 4 appearing at the respective stations s1, s2, s3, s4, . . . sn is transmitted from the CPU 11 to the display panels h1 . . . hn of the respective stations s1, s2, s3, s4, . . . sn by way of the image circuit 25.

Subsequently, occurrence of a win on the respective stations s1, s2, s3, s4, . . . ; namely, alignment, along the payout lines ht1 . . . on which individual players have bet coins or tokens beforehand, of symbols on the symbols reels 2, 3, and 4 which would constitute a winning combination, is determined by use of the win achievement symbol combination table stored in the ROM 12. Thus, payout information; that is, the number of winning players and the number of coins or tokens to be paid out, is determined.

Establishment of a winning combination is not necessarily set as a case where three symbols that constitute a winning combination are aligned.

The thus-determined payout information is transmitted from the CUP 11 to the hoppers by way of the output circuits 27 of the respective stations s1, s2, s3, s4, . . . sn. Coins or tokens corresponding to a reward for achievement of a win are paid to winning players and stored in the payout receivers m1, . . . mn.

The payout information is recorded on the RAM 13 or the hard disk drive 14 for respective stations s1, s2, s3, s4, . . . sn along with the bet information about the respective players.

When a bonus game is established as a result of combination of the symbols on the symbol reels 2, 3, 4 that are determined in an basic game, processing of a bonus game is performed.

Here, the bonus game is played in images appearing on the display panels 1*h* . . . of the respective stations s1, s2, s3, s4 . . . .

Image information about a bonus game is transmitted from the CPU 11 to the display panels 1*h* . . . of the respective stations s1, s2, s3, s4, . . . at which a bonus game is established, by way of the image circuit 25, whereby bonus game images are displayed.

Here, the image information about a bonus game corresponds to images showing spinning of the symbols 21 . . . on the symbol reel 2, spinning of the symbols 31 . . . on the symbol reel 3, and spinning of the symbols 41 . . . on the symbol reel 4. After lapse of a predetermined period of time counted by the timer, spinning actions of the symbol reels 2, 3, and 4 in the image are sequentially stopped, thereby determining a symbol on the symbol reel 2, that on the symbol reel 3, and that on the symbol reel 4. The thus-determined symbols appear on the display panels 1*h*.

Here, as in the case of an basic game, random numbers produced from the random number generator are used for random numbers to be used for determining the stop positions of the symbol reels 2, 3, 4 in the bonus game.

Subsequently, occurrence of a win is determined for the respective stations s1, s2, s3, s4, . . . where the bonus game is played, by use of the win achievement symbol combination table stored in the ROM 12. Thus, bonus payout information; that is, the number of winning players or the number of coins or tokens to be paid out, is determined.

The thus-determined bonus payout information is transmitted from the CPU 11 to the output circuit 27 of the stations s1, s2, s3, s4, . . . sn where the bonus games is played. Coins or tokens corresponding to a reward for achievement of a win are paid from the hoppers to winning players and stored in the payout receivers m1 . . . .

The bonus payout information is recorded on the RAM 13 or the hard disk drive 14 for respective stations s1, s2, s3, s4, . . . sn where bonus games is played.

When processing of the bonus game is completed, processing of an basic game is resumed.

Here, the game machine is constructed such that a bonus game is to be played in the form of an image by use of the display panels h1 . . . of the stations s1, s2, s3, s4 . . . where a bonus game is established. Needless to say, the bonus game can be performed by rotating actual symbol reels 2, 3, and 4.

There will now be described processing, such as storage/reference of game data pertaining to results of the basic games and those of the bonus games.

As mentioned previously, results of basic games and those of bonus games played on the respective stations s1, s2, s3, s4, . . . sn are recorded on the RAM 13 and the hard disk drive 14 along with bet information about the respective players.

When the game machine manager desires to refer to game result information, desired game results or data pertaining to game results are summated and displayed on the maintenance monitor 22 as various game result aggregates or statistic values for reference.

More specifically, when a request for displaying game results is sent to the CPU 11 by means of operation of the game machine manager, the CPU 11 reads game result information from the RAM 13 or the hard disk drive 14 and processes the information in accordance with the request by the game machine manager. The thus-processed information is transmitted to the maintenance monitor 22 as image information, by way of the image circuit 19.

The maintenance monitor 22 to which image information is transmitted from the CPU 11 displays a game result information image requested by the game machine manager.

The game machine manager displays, on the display panels h1 . . . of the arbitrary stations s1, s2, s3, s4, . . . sn, the game result information image to be displayed on the maintenance monitor 22.

When a player who plays games on the stations s1, s2, s3, s4, . . . sn desire to ascertain results of his/her games; for example, results of the games played in the past, a total number of inserted coins or tokens, and a total number of coins or tokens to be paid out, the player issues a request for displaying his/her game results by pressing a remaining credit ascertainment button of the control button section b1 on the operation table t1.

Then, a signal to be output from the button switch—which is to be turned on when the remaining credit ascertainment button of the control button section b1 is pressed—is transmitted to the CPU 11 by way of the input circuit 26.

Upon receipt of a request for displaying game results of a player, the CPU 11 reads game result information for each station from the RAM 13 or the hard disk drive 14 in accordance with the player's request and processes the thus-read game result information. The information is then transmitted to the display panel 1*h* as image information, by way of the image circuit 25.

The display panel h1 that is received the image information from the CPU 11 displays the game result information image requested by the player.

In this way, the players who play at the stations s1, s2, s3, s4, . . . sn can refer to desired game result information about their own games on the display panels h1.

Figure 10:
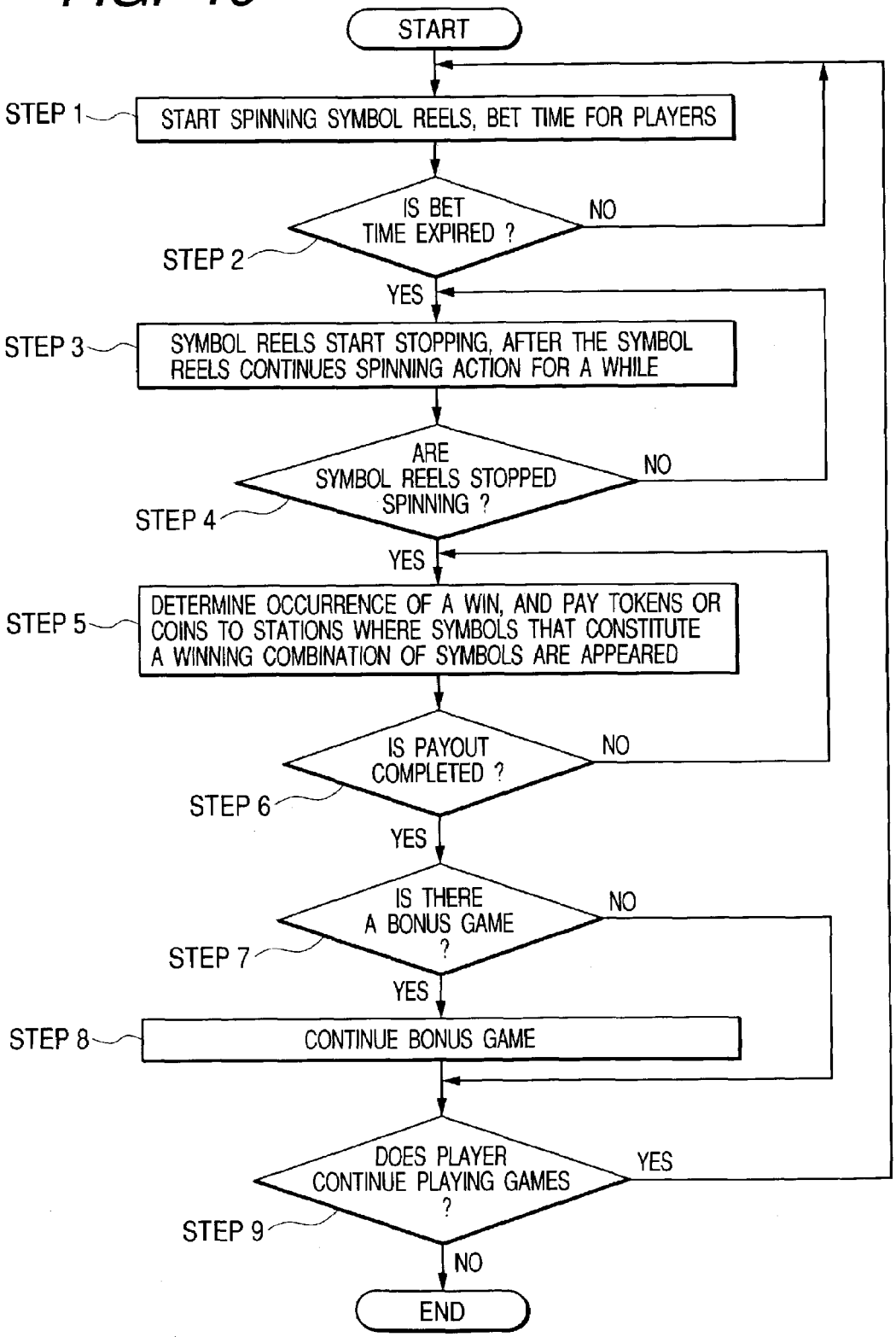
FIG. 10 is a flow chart showing the flow of a game to be played on a multi-station game machine of the embodiment.
Figure 11:
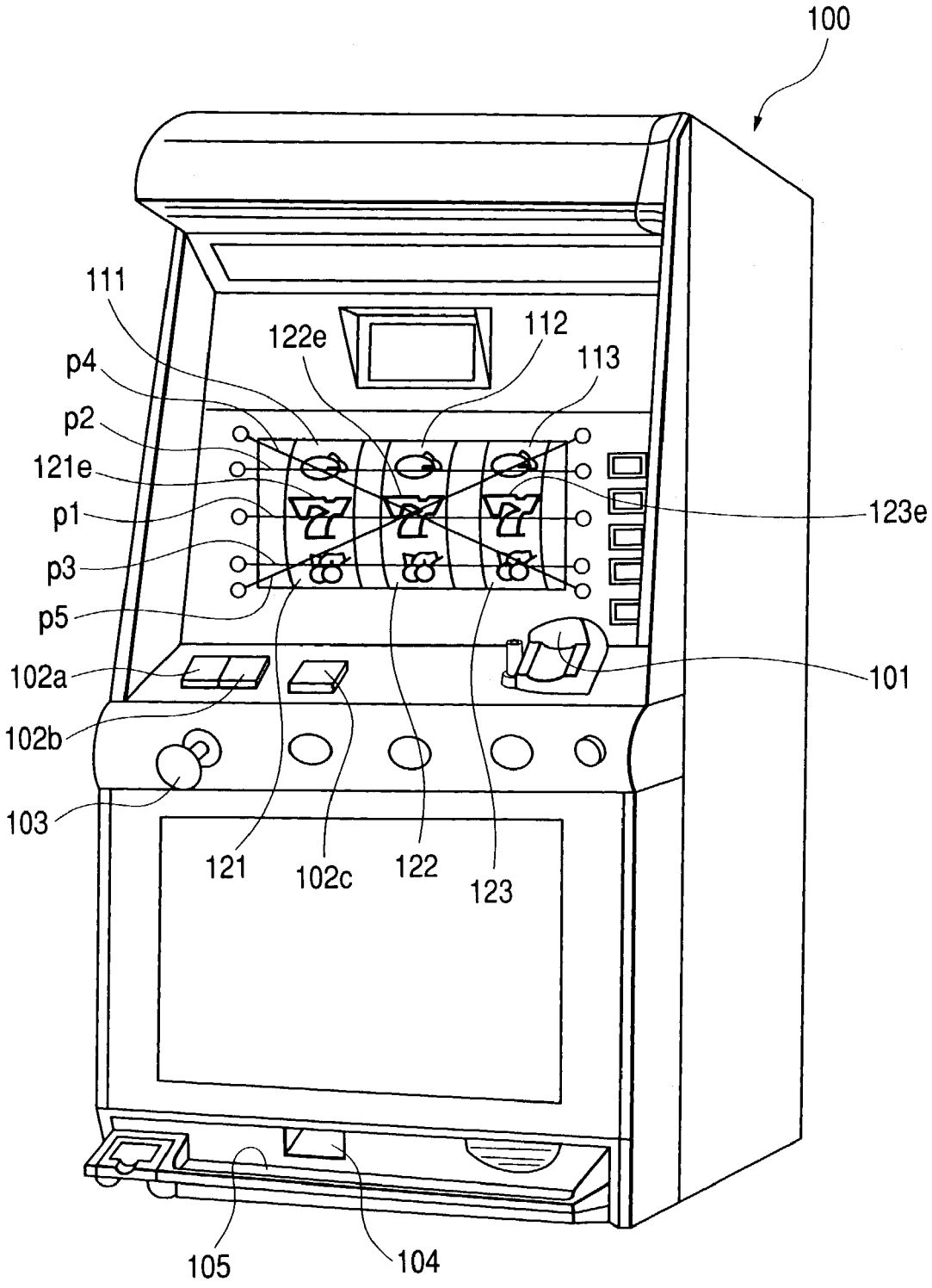
FIG. 11 is a perspective view showing a related game machine.

Next, the flow of a series of operations pertaining to a game to be played on the multi-station game machine 1 will be described by reference to FIG. 10.

When the game machine manager presses a game start button (not shown) of the multi-station game machine 1, (Step 1)

the symbol reels 2, 3, 4 start spinning.

The symbols 21 . . . on the spinning symbol reel 2, the symbols 31 . . . on the spinning symbol reel 3, and the symbols 41 . . . on the spinning symbol reel 4 concurrently appear on the display panels h1, . . . hn of the respective stations s1, s2, s3, s4, . . . sn. Further, a bet time information screen is displayed, thereby informing players of a bet time.

First, each of the players presses a line selection button of the control button section b1 on the bet time information screen, thereby selecting a desired payout lines ht11, ht12, ht13 . . . from the payout lines ht11, ht12, ht13 . . . appearing on the bet time information screen.

Subsequently, each of the players presses the bet button or the maximum bet button of the control button section b1, thereby setting and displaying a desired number of coins or tokens inserted by the player beforehand and still reserved, and bets the coins or tokens on the selected payout lines ht11, ht12, ht13 . . .

(Step 2)

When the bet time is completed, completion of the bet time is displayed on the display panels h1 of the respective stations s1, s2, s3, s4, . . . sn, thus terminating the bet time information screen.

(Step 3)

After completion of the bet time, game sound effects are emitted from the speaker p1 in association with spinning of the symbols 21 . . . on the symbol reel 2, spinning of the symbols 31 . . . on the symbol reel 3, and spinning of the symbols 41 . . . on the symbol reel 4. Further, sound images are caused to go around the game machine. Alternatively, the following control operation may be performed, as required. Namely, optical game effects are emitted from the game lamp u1, and illumination light or blinking light is caused to go around the game machine.

After lapse of a predetermined period of time from the end of the bet time, spinning of the symbol reel 2, that of the symbol reel 3, and that of the symbol reel 4 are sequentially stopped.

Here, when establishment of a winning combination is determined through internal random selection, the following presentation is also performed, as required. Namely, game sound effects are emitted from the speaker p1 located close to the symbols on the spinning symbol reels 2, 3, 4, which symbols would constitute a winning combination. Sound images are caused to go around the game machine, and optical game effects are emitted from the game lamp u1 located close to the symbols. Further, illumination light or blinking light is caused to go around the game machine.

For instance, when a winning combination is determined by means of internal random selection, game sound effects are emitted from the speaker p1 located close to the symbols on any of the spinning symbol reels 2, 3, 4, that would constitute a winning combination. Sound images are caused to go around the game machine, and optical game effects are emitted from the game lamp u1 located close to the symbols. Further, illumination light or blinking light is caused to go around the game machine.

Alternatively, as shown in FIG. 8, when a big winning combination is determined through internal random selection, the big win symbol 21*a* on the symbol reel 2 is stopped and aligned with any one of the payout lines ht11, ht12, ht13 . . . . Subsequently, the big win symbol 31*a* on the symbol reel 3 is stopped and aligned with the same payout line. Game sound effects for establishment of a big winning combination are emitted from the speaker p1*a* located close to the big win symbol 41*a* on the symbol reel 4, which reel is still spinning. In addition, attractive optical game effects for establishment of a big winning combination are emitted from the game lamp u1*a* located close to the big win symbol 41*a*. In association with movement of the big win symbol 41*a*, sound effects for establishment of a big winning combination and optical effects for establishment of a big winning combination are emitted.

The foregoing presentation of a game can also be applied to establishment of a winning combination other than a big winning combination; e.g., establishment of a medium winning combination, establishment of a small winning combination, establishment of a bonus game, or establishment of a winning combination involving a payout higher than a predetermined payout.

(Step 4)

Are all the symbol reels 2, 3, and 4 stopped?

(Step 5)

Occurrence of a win is determined for each of the stations s1, s2, s3, s4, . . . . Coins or tokens are paid to the stations s1, s2, s3, s4, . . . where players are achieved a win. In other words, coins or tokens corresponding to a reward for a win are paid and stored in the payout receivers m1 . . . .

(Step 6)

Is payout processing completed?

(Step 7)

Does a result of determination of occurrence of a win for each of the stations s1, s2, s3, s4, . . . show any winners in the stations s1, s2, s3, s4 . . . sn where a bonus game is established?

(Step 8)

When a bonus game is established in the stations s1, s2, s3, s4, . . . sn, a bonus game image appears on the display panels 1*h* of the stations s1, s2, s3, s4, . . . where a bonus game is to be played.

The symbols 21 . . . on the symbol reel 2, the symbols 31 . . . on the symbol reel 3, and the symbols 41 . . . on the symbol reel 4 are stopped in the bonus game image after spinning of the symbol reels, as required, whereby symbols on the symbol reels 2, 3, and 4 are determined, to thereby display the symbols on the display panels 1*h*.

Occurrence of a win is determined. A bonus payout; that is, coins or tokens corresponding to a reward for a bonus win, is paid from hoppers to winning players and stored in their payout receivers m1 . . . .

(Step 9)

When the players continue playing games, processing returns to (Step 1)

As mentioned above, the flow of a series of operations pertaining to a game to be played on the multi-station game machine 1 is described. As bonus games which are to be displayed and played on the display panels 1*h* of the stations s1, s2, s3, s4, . . . sn, games other than the combination game, such as card games or bingo games, may be employed.

In the embodiment, a combination game involving usage of the symbol reels 2, 3, 4 is performed first, and a bonus game is offered to solely the players who are awarded the right to play a bonus game, by way of the display panels 1*h*. Conversely, all players may individually play bonus game by way of the display panels 1*h* prior to a combination game involving usage of the symbol reels 2, 3, and 4. In the bonus game, only the players who are gained certain points are awarded the right to play a combination game involving usage of the symbol reels 2, 3, 4.

Various games can be realized by combination of the combination games involving usage of the symbol reels 2, 3, 4 and a bonus game appearing on the display panels 1*h*.

In the above configuration, players can play games at the stations s2, s3, s4, . . . disposed so as to surround the multi-station game machine 1. Hence, a plurality of players can enjoy playing games simultaneously.

As can be seen from FIGS. 2 through 7, all symbols on the symbol reels 2, 3, and 4 can be utilized for the games. Hence, payout lines can be produced for all symbols on the symbol reels 2, 3, and 4.

In addition, during the course of a game, speakers disposed around the symbol reels 2, 3, and 4 sequentially emit sound or become muted, and/or game lamps are sequentially illuminated and extinguished. Hence, attractive presentation of a game becomes possible.

Game sound effects are emitted from the speaker p1 in association with spinning of the symbols 21 . . . on the symbol reel 2, spinning of the symbols 31 . . . on the symbol reel 3, and spinning of the symbols 41 . . . on the symbol reel 4. Further, sound images are caused to go around the game machine; optical game effects are emitted from the game lamp u1; and illumination light or blinking light is caused to go around the game machine, thereby enabling presentation of a game which provides audiovisual stimulation.

When establishment of a winning combination is determined by symbols, or as a result of combination of symbols through internal random selection, game sound effects are emitted from the speaker located close to the symbols which are to constitute a winning combination and provided on any of the symbol reels, the reels being currently spinning and to stop; sound images are caused to go around the game machine; optical game effects are emitted from the game lamp u1 located close to the symbols that are to constitute a winning combination; and illumination light or blinking light is caused to go around the game machine, thereby augmenting interest in games.

Alternatively, establishment of a big winning combination is assumed to be determined by symbols or as a result of combination of symbols through internal random selection. Symbols that would constitute a winning combination are assumed to be stopped and aligned with a payout line. A symbol reel which is not stopped and whose symbol to be stopped is not determined is assumed to still be spinning. Only under these circumstances, if game sound effects are emitted from the speaker p1*a* located at a position corresponding to the symbols and optical game effects are emitted from the game lamp u1*a* located at a position corresponding to the symbols, sound images and illumination light or blinking light are caused to go around the game machine in association with spinning of the final symbol which is not determined to be stopped and would constitute a winning combination. Hence, the interest of the player who hopes for establishment of a winning combination is augmented more and more, thereby achieving a rich entertainment characteristic.

The reference payout lines are provided to respective players of stations, thereby making the stations explicit and easy to determine. Players can play games while clearly ascertaining their own stations.

Shared payout lines to be shared between adjacent players are provided on the game machine. Hence, when a winning combination is established along any of the shared payout lines, coins or tokens are excessively paid to adjacent players as a celebratory payout and a shared bonus payout, which are not provided by related game machines, thereby enabling a winning player to share the pleasure of winning with the adjacent players.

In this way, shared payout lines enable realization of additional payouts which are not available on the related game machines. Hence, a great merit for players is realized; that is, an increased chance of profitably betting coins or tokens on payout lines. Further, because of a demerit, which would otherwise be yielded when the player does not bet any coins or tokens on a shared payout line; that is, the impossibility of gaining a large amount of payout without betting coins or tokens on the shared payout lines, a player is motivated to bet coins or tokens on as many payout lines as possible in order to avoid experiencing regret or to achieve a win in a game. Hence, players can fully enjoy the pleasure of games, a feature which is not offered by related game machines.

In addition, players who achieves a win in the bonus game through a combination game involving usage of the symbol reels 2, 3, 4 can play bonus games by way of display panels after completion of the combination games.

Bonus games to be played over images appearing on the display panels can also be provided prior to a combination game involving usage of the symbol reels 2, 3, 4. By means of causing a combination game involving usage of the symbol reels 2, 3, 4 to be associated with a bonus game involving images appearing on display panels, a variety of games can be realized.

Accordingly, a plurality of players can enjoy playing games simultaneously. Further, players can share payout lines, thereby realizing additional payouts. Thus, there is realized a multi-station game machine which enables augmentation of interest in games and is rich in entertainment characteristic.

In the embodiment, symbol reels are constructed in three layers. However, the number of symbol reels can be arbitrarily set to two layers, four layers, five layers, or any other number of layers, as required.

Although the symbol reels are constructed so as to spin individually and horizontally around a vertical axis, needless to say, symbol reels can be constructed so as to be able to individually and substantially horizontally spin around a substantially vertical axis.

The embodiment is illustrated a multi-station game machine which offers a combination game. Needless to say, the multi-station game machine of the invention can be effectively applied to even a game machine which offers another game and in which reels are spun within a substantially horizontal plane.

What is claimed is:

1. A multi-station game machine, comprising:

at least two operating stations that are configured to accept player inputs;

a plurality of reels, each reel having a plurality of symbols, and the reels spinning horizontally around a vertical axis; and a payout unit that pays a payment when a winning combination of symbols is established on the payout line which is betted, wherein the reels are arranged coaxially in the vertical direction;

wherein each of the reels is configured to enable at least two players to play a game on the game machine simultaneously using the operating stations, respectively;

wherein the plurality of symbols of the reels define a plurality of game areas on which the game is performed simultaneously;

wherein the operating stations are configured such that the players bet a game value on a payout line of the reels;

wherein the payout line includes a shared payout line which is betted by an adjacent operating station; and wherein the payout unit is configured such that when at least one of the players bets a game value on the shared payout line, at least one player does not bet any game value on the shared payout line, and the winning combination is established along the shared payout line, the payout unit pays a first payment to the players that bet on the shared payout line as a reward for establishment of the winning combination, and also pays a second payment to the at least one player that did not bet on the shared payout line.

2. A multi-station game machine, comprising:

at least two operating stations that are configured to accept player inputs;

a plurality of reels, each reel having a plurality of symbols, and the reels spinning horizontally around a vertical axis; and a payout unit that pays a payment when a winning combination is established on a payout line which is betted, wherein the reels are arranged coaxially in the vertical direction;

wherein each of the reels is configured to enable at least two players to play a game on the game machine simultaneously using the operating stations, respectively;

wherein the plurality of symbols of the reels define a plurality of game areas on which the game is performed simultaneously;

wherein the operating stations are configured such that the players bet a game value on a payout line of the reels;

wherein the payout line includes a shared payout line which is betted by an adjacent operating station; and wherein the payout unit is configured such that when the players bet a game value on the shared payout line, and the winning combination is established along the shared payout line, the payout unit pays an additional payment as well as a normal payment as a reward, for establishment of the winning combination to each of the players.

3. A multi-station game machine, comprising:

at least two operating stations that are configured to accept player inputs, the operating stations including a first operating station and a second operating station;

a plurality of displays, each of which is configured to display a symbol array, which is movable in a first direction and having a plurality of symbols arranged in the first direction; and a payout unit that pays a payment when a winning combination of symbols is established on the payout line which is betted, wherein the displays are arrayed in a vertical direction;

wherein first ones of the symbol arrays that are arranged in the vertical direction in front of the first operating station establishes a first combination of the symbols;

wherein second ones of the symbol arrays that are arranged in the vertical direction in front of the second operating station establishes a second combination of the symbols;

wherein the first combination and the second combination are established simultaneously;

wherein the operating stations are configured such that the players bet a game value on a payout line on the displays;

wherein the payout line includes a shared payout line which is betted by an adjacent operating station; and wherein the payout unit is configured such that when at least one of the players bets a game value on the shared payout line, at least one player does not bet any game value on the shared payout line, and the winning combination is established along the shared payout line, the payout unit pays a first payment to the players that bet on the shared payout line as a reward for establishment of the winning combination, and also pays a second payment to the at least one player that did not bet on the shared payout line.

4. A multi-station game machine, comprising:

at least two operating stations that are configured to accept player inputs, the operating stations including a first operating station and a second operating station;

a plurality of displays, each of which is configured to display a symbol array, which is movable in a first direction and having a plurality of symbols arranged in the first direction; and a payout unit that pays a payment when a winning combination of the symbols is established on the payout line which is betted, wherein the displays are arrayed in a vertical direction;

wherein first ones of the symbol arrays that are arranged in the vertical direction in front of the first operating station establishes a first combination of the symbols;

wherein second ones of the symbol arrays that are arranged in the vertical direction in front of the second operating station establishes a second combination of the symbols;

wherein the first combination and the second combination are established simultaneously;

wherein the operating stations are configured such that the players bet a game value on a payout line on the displays;

wherein the payout line includes a shared payout line which is betted by an adjacent operating station; and wherein the payout unit is configured such that when adjacent players bet a game value on the shared payout line, and the winning combination is established along the shared payout line, the payout unit pays an additional payment as well as a normal payment as a reward for establishment of the winning combination to each of the players.

* * * * *